US008167402B2

(12) United States Patent
Misumi et al.

(10) Patent No.: US 8,167,402 B2
(45) Date of Patent: May 1, 2012

(54) INK JET PRINTING APPARATUS AND INK JET PRINTING METHOD

(75) Inventors: Yoshinori Misumi, Tokyo (JP); Nobuyuki Matsumoto, Tokyo (JP); Hiroyuki Murayama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1090 days.

(21) Appl. No.: 11/617,208

(22) Filed: Dec. 28, 2006

(65) Prior Publication Data

US 2007/0165064 A1 Jul. 19, 2007

(30) Foreign Application Priority Data

Dec. 28, 2005 (JP) ..... 2005-380071

(51) Int. Cl.
*B41J 2/165* (2006.01)

(52) U.S. Cl. ..... 347/35

(58) Field of Classification Search ..... 347/35
See application file for complete search history.

(56) References Cited

U.S. PATENT DOCUMENTS

| | | | | |
|---|---|---|---|---|
| 5,659,342 | A * | 8/1997 | Lund et al. | 347/35 |
| 6,089,686 | A * | 7/2000 | Thornton et al. | 347/7 |
| 6,709,088 | B2 * | 3/2004 | Hayakawa et al. | 347/31 |
| 2007/0291057 | A1 * | 12/2007 | Iwao et al. | 347/10 |

FOREIGN PATENT DOCUMENTS

JP 8-112904 5/1996

* cited by examiner

*Primary Examiner* — Matthew Luu
*Assistant Examiner* — Alejandro Valencia
(74) *Attorney, Agent, or Firm* — Fitzpatrick, Cella, Harper & Scinto

(57) ABSTRACT

In a structure in which a printing medium is subjected to a maintenance ejection in order to maintain a favorable ink ejection performance of a printing head, dots formed on the printing medium by the maintenance ejection have a reduced visibility. Specifically, an area of dots formed by landing ink droplets ejected from the printing head for the maintenance ejection onto the printing medium is smaller than an area of similar dots formed by a normal printing. Specifically, by flowing currents having different waveforms into an ejection heater of the printing head depending on the ejection for printing an image and the maintenance ejection, an area of dots formed by the maintenance ejection can be smaller than an area of dots formed by the normal ejection for printing an image.

6 Claims, 18 Drawing Sheets

DRIVING WAVEFORM

DRIVING WAVEFORM

EJECTION CONDITION

EJECTION CONDITION

LANDING POINT

LANDING POINT

| | NORMAL EJECTION | | | MAINTENANCE EJECTION |
|---|---|---|---|---|
| INK AMOUNT | 5pl | 3.0pl | 1.5pl | 1.9pl |
| DOT AREA | 1942μm² | 1018μm² | 628μm² | 512μm² |
| PHOTOBLACK | × | × | △ | ○ |
| CYAN | × | × | △ | ○ |
| MAGENTA | × | × | △ | ○ |
| YELLOW | × | △ | ○ | ○ |
| PHOTOCYAN | × | △ | ○ | ○ |
| PHOTOMAGENTA | × | △ | ○ | ○ |

FIG.13

DRIVING WAVEFORM

DRIVING WAVEFORM

EJECTION CONDITION

EJECTION CONDITION

LANDING POINT

LANDING POINT

| | NORMAL EJECTION | | | MAINTENANCE EJECTION |
|---|---|---|---|---|
| INK AMOUNT | 5pl | 3.0pl | 1.5pl | 1.1pl |
| DOT AREA | 1942μm$^2$ | 1018μm$^2$ | 628μm$^2$ | 410μm$^2$ |
| PHOTOBLACK | × | × | △ | ○ |
| CYAN | × | × | △ | ○ |
| MAGENTA | × | × | △ | ○ |
| YELLOW | × | △ | ○ | ○ |
| PHOTOCYAN | × | △ | ○ | ○ |
| PHOTOMAGENTA | × | △ | ○ | ○ |

FIG.15

INK JET PRINTING APPARATUS AND INK JET PRINTING METHOD

BACKGROUND OF THE INVENTION

1. Field of the Invention

The present invention relates to an ink jet printing apparatus and an ink jet printing method by which a printing is performed by ejecting liquid droplets (hereinafter referred to as ink) to a printing medium for performing a printing. In particular, the present invention relates to a structure for performing, to a printing medium, a maintenance ejection (also called as preliminary ejection) for maintaining a favorable ejection performance of a printing head for ejecting ink.

2. Description of the Related Art

An ink jet printing method has an advantage in that low noise and low running cost are realized, the apparatus can have a smaller size, and the apparatus that performs color printing can be realized easily for example. Printing heads for ejecting color ink in particular have been involved with a tendency where a droplet size of ink droplets ejected from printing heads have been reduced from about 15 pl through 5 pl to 2 pl. As a result, ink droplets having a smaller dot size constituting a printed image can be provided so as to reduce the granularities of a half tone part in a gray scale image, and a halftone part and a highlight part in a color photograph image. With an advancement and widespread diffusion of digital devices in particular, printing of a high-resolution image and a high-quality printing, such as a photograph printing, have been increasingly required and a further smaller liquid droplet has been also required. In according with this, an ink ejection nozzle of a printing head has been provided with a smaller opening diameter.

When a nozzle has a smaller opening diameter, defective ejection due to ink having an increased viscosity or the like (e.g., an abnormal ejection in which ink is ejected in a bent direction or an ink droplet does not reach a paper, and an ejection failure in which ejection itself is not performed) is caused easily. In order to solve the defective ejection as described above, a conventional ink jet printing apparatus is structured so that a maintenance ejection (preliminary ejection) is performed just before a printing operation or in the middle of a printing operation with a fixed interval, in which ink is ejected to a predetermined portion of the apparatus (e.g., an ink receiver including a discharged ink absorber). Thus, ink having an increased viscosity in the vicinity of an opening of a nozzle or a nozzle flow path can be ejected to maintain a correct ink ejection performance. This maintenance ejection performs a few to a dozen of ink droplet ejection with an interval of about 2 to 15 seconds, depending on the ejection power of a used printing head, the dry level of used ink, or an environment temperature.

However, the maintenance ejection is performed during a printing operation to a printing medium or during supply or discharge operation of a plurality of pages of printing medium and thus requires a printing head to be moved to a predetermined position other than the position of a printing medium (e.g., discharged ink absorber). Thus, a tradeoff relation is established between a time required for the maintenance ejection and a time required for a unit of printing data (hereinafter referred to as print throughput). In a high speed printing mode in which a printing head is moved with a high speed or ink is ejected from a printing head with the maximum driving frequency in order to minimize the time required for a printing operation for each page in particular, the time loss due to the maintenance ejection operation required for the maintenance is relatively high. For example, this loss is so high as to occupy a few to a dozen of percentages of the entire printing time.

Specifically, this time loss is investigated for a case where all nozzles in a range of a width of a nozzle arrangement of a printing head are used to print to-be-printing data for one line by one scanning operation. When assuming that an A4-sized printing medium has a printable region of 8"×11" and when the entirety of this printing medium is printed with the data by a printing head having an ink droplet size of 5 pl, 256 nozzles arranged with 1200 dpi, and an arrangement width of 0.21 inch, about 52 scanning (scanning with printing head+paper line feed) are required. It is assumed that the printing head has a driving frequency of 15 kHz and a scanning speed of 25 inch/second. In this case, if a line feed time of a conveyed paper and the time required for the rise and decay of the scanning operation of a printing head are 0.1 second, a printing time for one line is about 0.52 seconds and a time required for the printing of one A4-sized paper is about 27 seconds. When assuming that an interval between maintenance ejections is 5 seconds, a rate of a time required for the maintenance ejection to one page can be approximately calculated as shown below. The maintenance ejection is performed five times for one page. One maintenance ejection requires a printing head to be additionally moved by a distance corresponding to the distance for one scanning operation. As a result, the rate of a time required for the maintenance ejection to one page can be calculated as: maintenance ejection by 5 scanning/printing by 52 scanning=0.096 that is nearly equal to about 10% time loss.

Furthermore, when a printing head has a reduced nozzle opening diameter so that ejected liquid droplets can have a size of about 2 pl, an interval between maintenance ejections is reduced to about 2 seconds. In this case, maintenance ejection is performed within a page 13 times. In this case, the same approximate calculation results in: maintenance ejection by 13 scanning/printing by 52 scanning=0.25 that is nearly equal to about 25% time loss. Thus, a decline of the print throughput is 2.5 times higher than the case of 5 pl is caused.

In view of the above, Japanese Patent Application Laid-open No. H8-112904 has disclosed a structure for improving the decline of a print throughput due to the maintenance ejection by a printing head. This structure reduces operations required for the maintenance ejection by ejecting such ink onto a printing medium that is not for an image formation purpose.

However, the structure in which a printing medium is subjected to the maintenance ejection causes separate inks for the maintenance ejection to be ejected into an image to be printed and thus may cause a case where dots by the separate inks are so noticeable that the dots can be visually recognized. The noticeable dots of ink ejected for the maintenance ejection causes a problem where the resultant printed image has a lower quality.

The present inventors have examined a size (area) of dots and the shape of a dot that are visually recognized easily. Specifically, ink ejection from a printing head to a printing medium was performed with respect to different volumes of ink droplets, different colors of inks, and different driving conditions to examine the visibility of the resultant dots in a sensory manner. The term "visibility" herein means how much the dots are noticeable and is determined by allowing a person having binocular vision of about 1.0 to 1.5 to see a printing medium on which the dots are formed with a distance of about 20 cm between the person and the printing medium.

As a result, it was found that, with a smaller dot formed by ejected ink, the visibility of the dot on the printing medium is reduced (which means that the dot is more difficultly seen) as is obviously expected and the respective dot shapes and colors have different visibilities.

SUMMARY OF THE INVENTION

An objective of the invention is to provide an ink jet printing apparatus and an ink jet printing method by which dots of ink for the maintenance ejection formed on a printing medium can have a reduced visibility.

In a first aspect of the present invention, there is provided an ink jet printing apparatus that uses a printing head ejecting ink to perform printing by ejecting ink to a printing medium, said apparatus comprising: head driving means for controlling driving of the printing head to case the printing head to eject ink; and maintenance means for executing a maintenance ejection to the printing medium in order to maintain a given ejection state of the printing head, wherein, when said maintenance means executes the maintenance ejection, said head driving means causes the printing head to eject ink according to a second driving condition which is different from a first driving condition, according to which said head driving means cause the printing head to eject ink for performing the printing on the printing medium, and an area of a dot formed on the printing medium with ink ejected according to the second driving condition is smaller than that with ink ejected according to the first driving condition.

In a second aspect of the present invention, there is provided an ink jet printing method for performing printing by uses a printing head ejecting ink and ejecting ink to a printing medium, said method comprising: a preparing step for preparing driving means for controlling driving of the printing head to case the printing head to eject ink; and a maintenance ejection execution step for executing a maintenance ejection to the printing medium in order to maintain a given ejection state of the printing head, wherein, when said maintenance ejection execution step executes the maintenance ejection, the driving means causes the printing head to eject ink according to a second driving condition which is different from a first driving condition, according to which the driving means cause the printing head to eject ink for performing the printing on the printing medium, and an area of a dot formed on the printing medium with ink ejected according to the second driving condition is smaller than that with ink ejected according to the first driving condition.

According to the above structure, when compared with a normal printing, the maintenance ejection can cause a reduced area of dots formed on a printing medium. This can suppress a case where dots formed by the maintenance ejection in a printed image are visually recognized to deteriorate the image quality.

Further features of the present invention will become apparent from the following description of exemplary embodiments (with reference to the attached drawings).

BRIEF DESCRIPTION OF THE DRAWINGS

FIG. 13 is a chart illustrating the evaluation of the visibility of dots by the ejection for the image printing and dots by the maintenance ejection according to the above first embodiment;

FIG. 15 is a chart illustrating the evaluation of the visibility of dots by the ejection for the image printing and dots by the maintenance ejection according to the above second embodiment;

DESCRIPTION OF THE EMBODIMENTS

Hereinafter, embodiments of the present invention will be described with reference to the drawings.

First, an embodiment of an ink jet printing apparatus for performing the maintenance ejection will be described and then the maintenance ejection according to embodiments of the present invention will be described.

Structure of Entire Printing Apparatus

Figure 1:
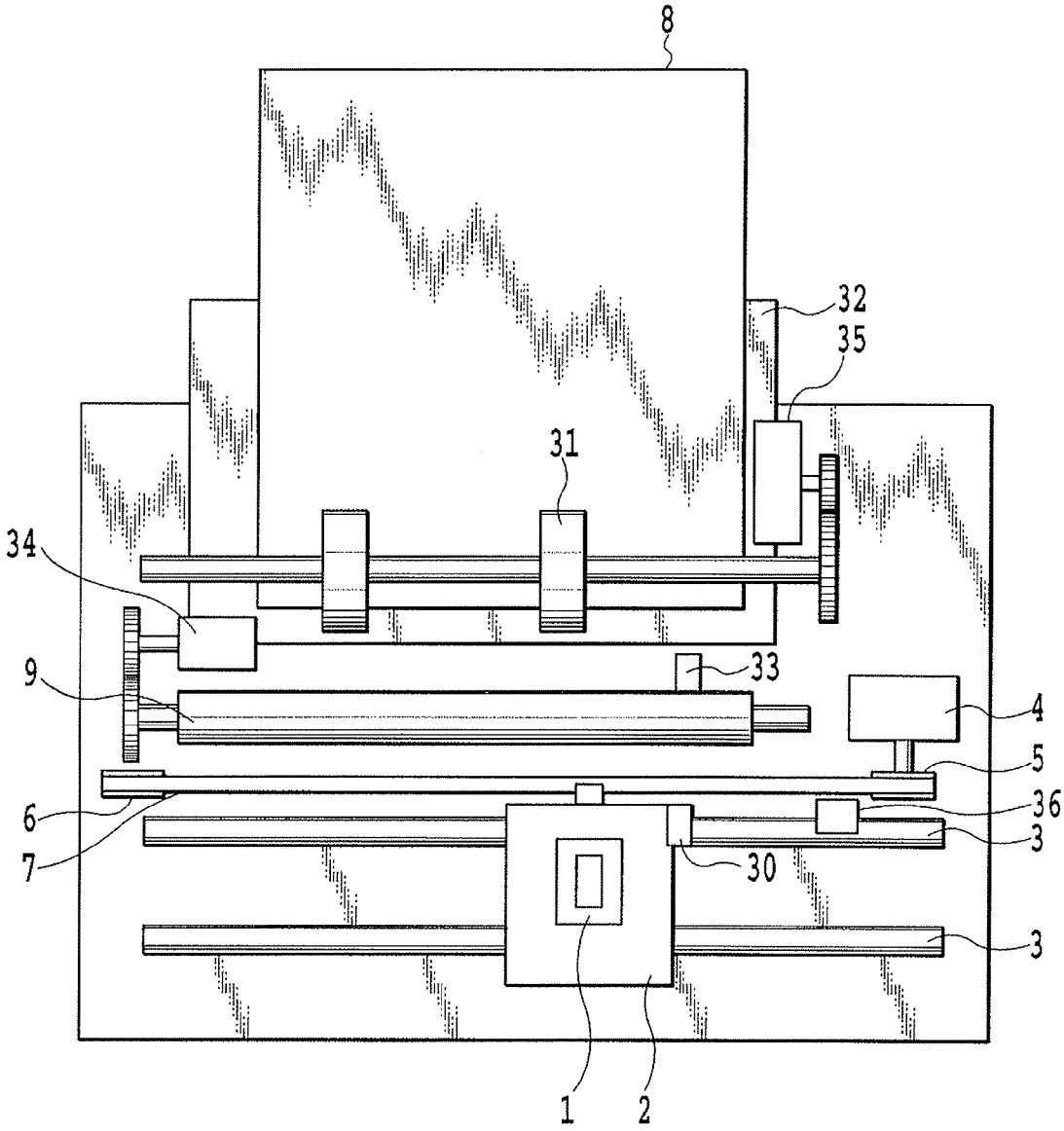
FIG. 1 is a top view illustrating a schematic structure of an ink jet printing apparatus according to one embodiment of the present invention.

FIG. 1 is a top view illustrating a schematic structure of an ink jet printing apparatus according to one embodiment of the present invention. In FIG. 1, a head cartridge 1 is attached to a carriage 2 in a detachable manner. The head cartridge 1 includes a printing head portion and an ink tank mounting section. Specifically, an ink tank is attached to this head cartridge 1 in a detachable manner. The head cartridge 1 includes a connector for communicating a signal for driving the printing head portion for example (not shown) The carriage 2 includes a connector holder (electric connection section) for transmitting, via the above connector, a driving signal for example to the respective printing head cartridges 1.

The carriage 2 is guided along and supported to be reciprocated by a guide shaft 3 that extends in a main scanning direction and that is provided in a main body of the apparatus. The carriage 2 is driven by a main scanning motor 4 via a driving mechanism (e.g., motor pulley 5, driven pulley 6, and timing belt 7). The carriage 2 also includes a home position sensor 30. As a result, the position of the carriage 2 can be detected when the home position sensor 3 on the carriage 2 passes the position of a blocking plate 36. Based on the detection of the position, the position and movement of the carriage are controlled via the above driving mechanism.

A printing medium 8 such as a printing paper or a plastic thin plate is separated and supplied from an auto sheet feeder (hereinafter referred to as ASF) 32 by that a paper-feeding motor 35 rotates a pickup roller 31 via a gear. Furthermore, by the rotation of a transportation roller 9, the printing medium 8 passes a position opposed to a ejection (nozzle) surface of the printing head portion in the head cartridge 1 and is transported (sub scanning). The transportation roller 9 rotates when receiving the driving force of an LF motor 24 via a gear. Then, the determination with regards to whether a paper supply is performed or not and the detection of a top position during a paper supply operation are performed when the printing medium 8 passes a paper end sensor 33. Furthermore, the paper end sensor 33 is also used to determine a position at which a rear end of the printing medium 8 is actually placed to finally detect an actual current printing position based on the actual rear end. It is noted that the back face of the printing medium 8 is supported by a platen (not shown) so as to form a flat print surface in the printing section. In this case, the respective printing head portions provided in the carriage 2 are retained so that the ejection opening faces thereof protrude from the carriage 2 in a lower direction and thus the ejection opening faces are in parallel with the printing medium 8 between the two pairs of transportation rollers.

The head carriage 1 is based on an ink jet method for example in which thermal energy is used to ejection ink and includes an electro-thermal conversion element for generating the thermal energy. Specifically, the head cartridge 1 includes the printing head that is based on a method in which film boiling generated by thermal energy supplied by the above electro-thermal conversion element is used to use the pressure of the bubbles to ejection ink from a ejection opening. It is noted that the ejection method may be other methods such as the one by a piezoelectric element.

Figure 2:
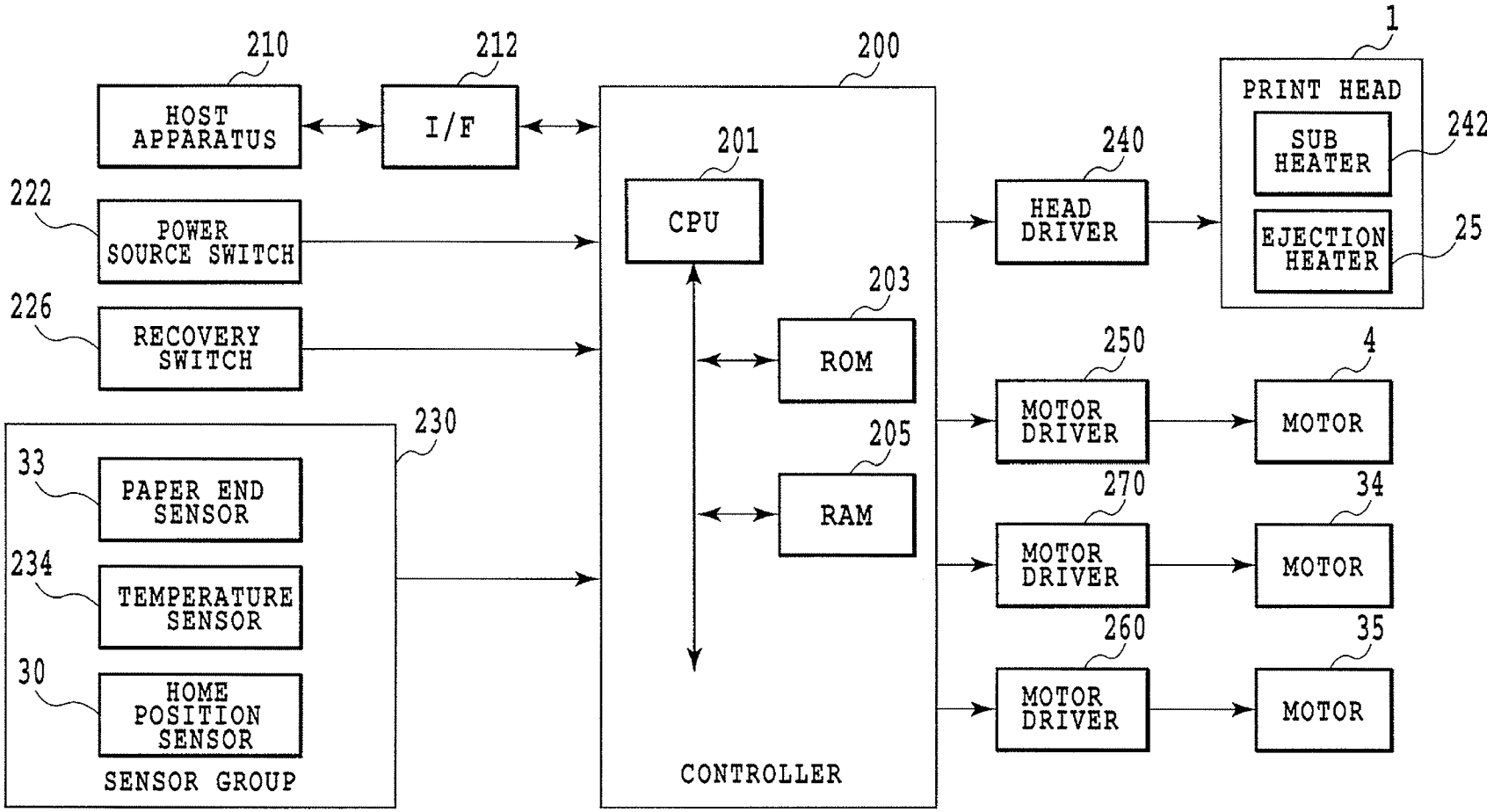
FIG. 2 is a block diagram illustrating an example of a schematic structure of a control circuit in the ink jet printing apparatus shown in FIG. 1.

FIG. 2 is a block diagram illustrating an example of a schematic structure of a control circuit in the ink jet printing apparatus. In FIG. 2, a controller 200 is a main control section that includes, for example, a CPU 201 in the form of a microcomputer, a ROM 203 in which fixed data (e.g., program, required table) is stored, and a RAM 205 having a region in which image data is developed and a working region or the like. A host apparatus 210 is a supply source of image data (which may be a computer for preparing or processing data of an image for printing or may be a reader section for reading an image). Image data, other commands, status signals or the like are sent to or received from the controller 200 via an interface (I/F) 212.

A power source switch 222 and a recovery switch 226 for instructing the start of an absorption recovery or the like are a switch group that accepts an input of an instruction by an operator. A sensor group 230 is a sensor group for detecting the status of the apparatus and includes the above-described home position sensor 30, the paper end sensor 33 for detecting the existence or nonexistence of a printing medium, and a temperature sensor 234 provided at an appropriate portion for detecting an environment temperature for example.

The head driver 240 is a driver that drives, in accordance with ejection data or the like, the ejection heater (electro-thermal conversion element) 25 of the printing head portion in the head cartridge 1. The head driver 240 has a shift register for arranging ejection data so as to correspond to the position of the ejection heater 25, a latch circuit for latching ejection data with a predetermined timing, and a logic circuit element for operating the ejection heater in synchronization with a driving timing signal based on the ejection data. In addition, the head driver 240 has a timing setting section for appropriately setting a driving timing (ejection timing) for the positioning of a dot formation position for example. The head cartridge 1 includes a sub heater 242. The sub heater 242 is used to adjust a temperature in order to stabilize the ink ejection characteristic of ink and can be formed on a printing substrate simultaneously with the ejection heater 25 or can be attached to the printing head cartridge.

A motor driver 250 is a driver for driving the main scanning motor 4. A sub scanning motor 34 is used to transport the printing medium 8 (sub scanning) and the operation is controlled by the motor driver 270. The paper feed motor 35 is a motor for separating and feeding the printing medium 8 and the operation is controlled by the motor driver 260.

Head Cartridge

FIG. 3 to FIG. 9 are views illustrating a head cartridge according to this embodiment, the printing head portion thereof, an ink tank attached to the head cartridge, and the relation thereamong.

Figure 3B:
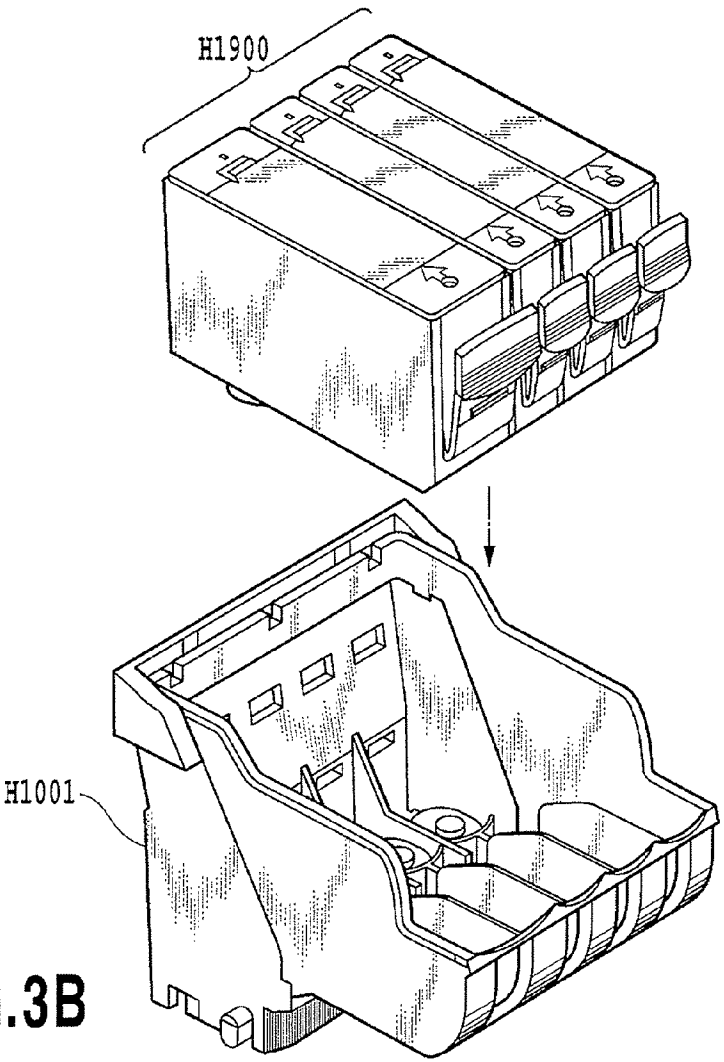
FIGS. 3A and 3B are a perspective view illustrating the structure of a head cartridge according to one embodiment of the present invention.
Figure 3A:
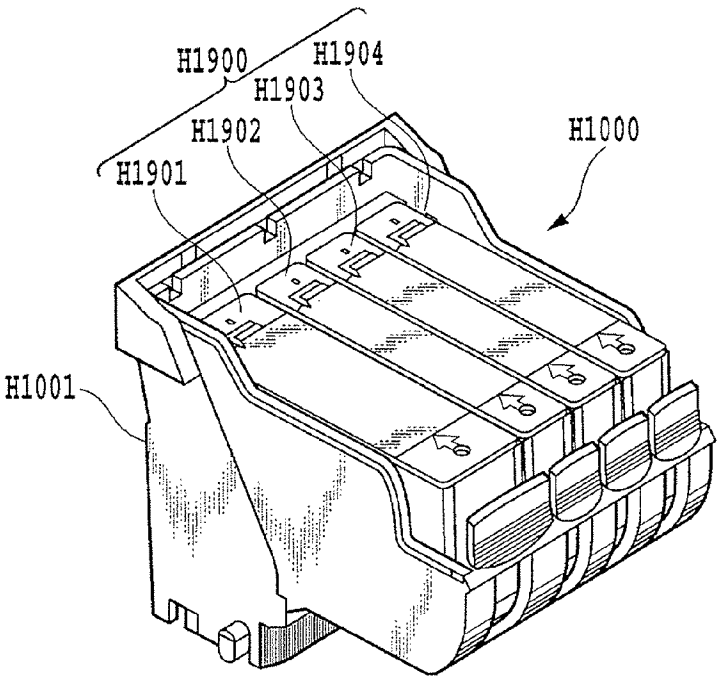
Figure 4:
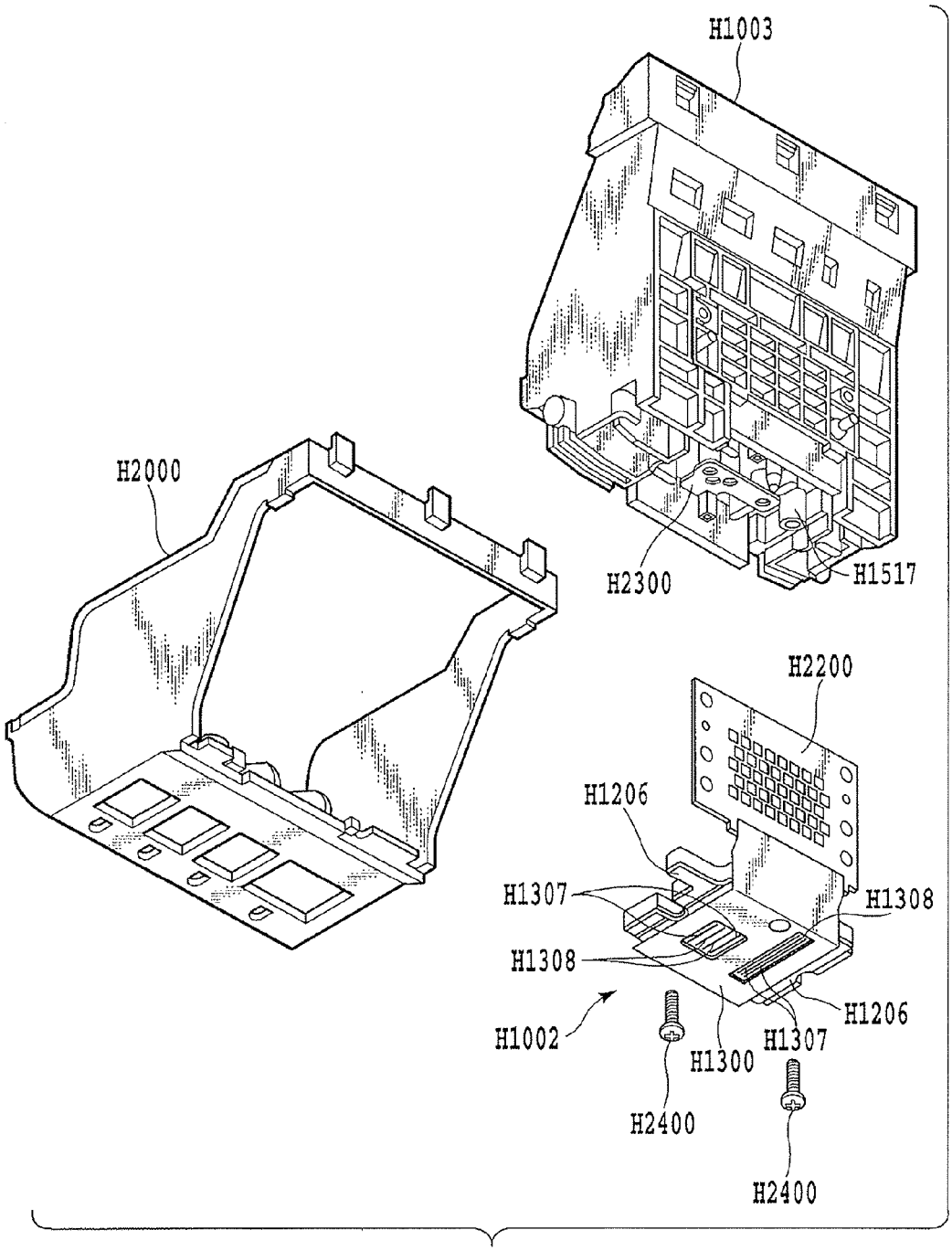
FIG. 4 is an exploded perspective view illustrating a printing head portion constituting the cartridge.

As can be seen from the perspective views of FIG. 3A and FIG. 3B, the printing head portion H1001 is one component constituting the head cartridge 1 (hereinafter denoted by the reference numeral H1000). The printing head portion H1001 is structured to include a printing head portion H1001 and an ink tank H1900 provided in a detachable manner. The head cartridge H1000 is fixed and supported by a cartridge (not shown) in which the head cartridge is positioned to the carriage of an ink jet printing apparatus main body with a positioning mechanism, an electrical connection therebetween is established with the contact of electrical contact points, and the head cartridge H1000 is detachable to the carriage.

The ink tank H1900 is composed of four ink tanks of a black ink tank H1901, a cyan ink tank H1902, a magenta ink tank H1903, and a yellow ink tank H1904. These ink tanks H1901, H1902, H1903 and H1904 are independently detachable to the printing head portion H1001 and can be exchanged with the new one, respectively. By the structure as described above, the ink tank H1900 can be appropriately exchanged so that ink can be economically used. Thus, the ink jet printing apparatus can have a reduced running cost for the printing operation.

(1) Printing Head Portion

Figure 5:
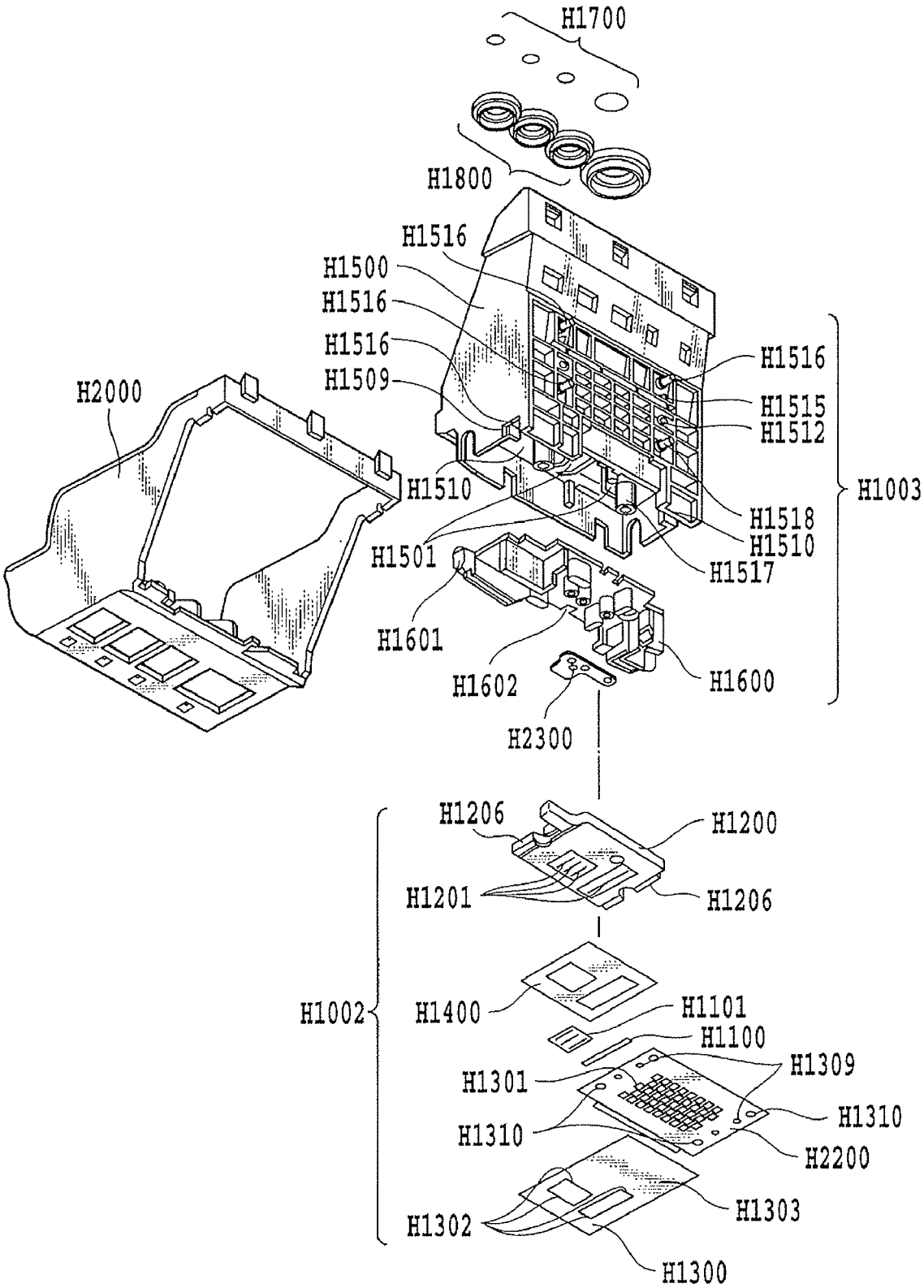
FIG. 5 is an exploded perspective view illustrating the details of a printing element unit in the cartridge.

The printing head portion H1001 uses a ejection method based on a bubble jet method (registered trademark) in which an electro-thermal conversion element for generating thermal energy for causing ink to have film boiling is used depending on an electric signal. Furthermore, the so-called side shooter type printing head is used in which an electro-thermal conversion element is opposed to an ink ejection opening. As shown in the exploded perspective view of FIG. 4, the printing head portion H1001 is composed of a printing element unit H1002, an ink supply tank unit (liquid supply tank unit) H1003, and a tank holder H2000. Furthermore, the exploded perspective view of FIG. 5 shows the details of the printing element unit H1002. Specifically, the printing element unit H1002 is composed of the first printing element substrate H1100, the second printing element substrate H1101, the first plate H1200, an electric wiring substrate H1300, an electrical contact substrate H2200, and the second plate H1400. The ink supply unit H1003 is composed of an ink supply member H1500, a flow path formation member H1600, a joint seal member H2300, a filter H1700, and a seal rubber H1800.

(1-1) Printing Element Unit

The first plate H1200 is composed of alumina material (A1203) having a thickness of 0.5 to 10 mm for example. The material of the first plate H1200 is not limited to alumina. The first plate H1200 also may be composed of other materials that have the same linear expansion coefficient as that of the materials of the printing element substrates H1100 and H1101 and that have a thermal conductivity equal to or higher than the materials of the printing element substrates H1100 and H1101. For example, the first plate H1200 may be made, for example, of any of silicon (Si), aluminum nitride (AlN), zirconia, silicon nitride (Si3N4), silicon carbide (SiC), molybdenum (Mo), or tungsten (W). The first plate H1200 includes, as an ink supply opening H1201, the one for supplying black ink to the first printing element substrate H1100 and the one for supplying cyan, magenta, and yellow ink to the second printing element substrate H1101. Both ends have screw locking portions H1206 for the connection to the ink supply unit H1003.

Figure 6:
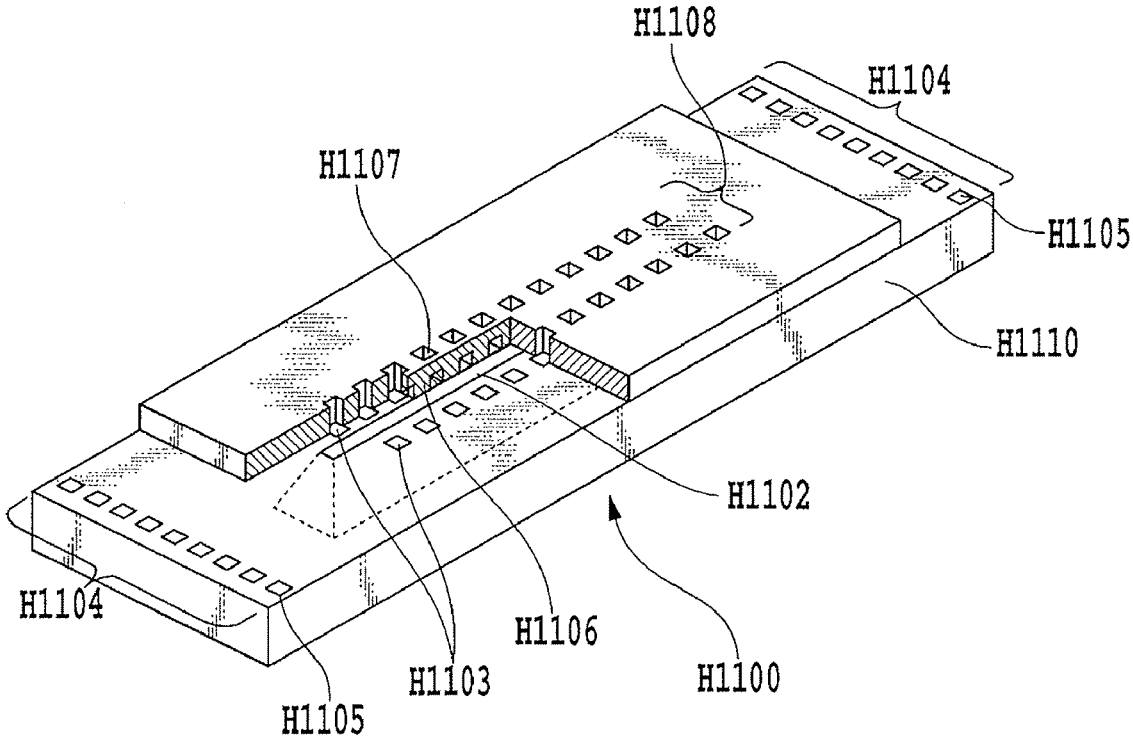
FIG. 6 is a partial perspective view for explaining the structure of the first printing element substrate for black ink in the cartridge.

FIG. 6 is a partially cutaway perspective view for explaining the structure of the first printing element substrate H1100 for black ink of high frequency in use. The first printing element substrate H1100 includes, for example, an ink supply opening H1102 as a long groove-like penetrating opening as an ink flow path that is provided in an Si substrate H1110 having a thickness of 0.5 to 1 mm. Both sides sandwiching the ink supply opening H1102 have electro-thermal conversion elements H1103 each of which is arranged in one column and also includes electric wirings (not shown) composed of Al or the like for supplying power to the electro-thermal conversion element H1103. These electro-thermal conversion elements H1103 and electric wirings are formed by a film formation technique. The respective columns of the electro-thermal conversion elements H1103 are arranged in a staggered manner. Specifically, the respective columns have ejection openings that are arranged so as to be arranged in a slightly dislocated manner in a direction orthogonal to the row direction. Furthermore, electrode sections H1104 for supplying power to this electric wiring are arranged along both outer sides of the electro-thermal conversion element H1103. The electrode section H1104 has thereon a bump H1105 composed of Au or the like. On the surface of the Si substrate H1110 on which they are formed, a head structure is formed. Specifically, this structure has an ink flow path wall H1106 forming an ink flow path corresponding to the electro-thermal conversion element H1103 and a top section covering the upper part and the top section includes a ejection opening H1107 having an opening shape. They are composed of resin material and are formed by the photolithography technique. The ejection opening (nozzle) 1107 is opposed to the electro-thermal conversion element H1103 to form the ejection opening group H1108. In this first printing element H1100, ink supplied from the ink flow path H1102 is ejected, by the pressure by bubbles generated by the heat generation from the respective electro-thermal conversion elements H1103, from the ejection openings 1107 opposed to the respective electro-thermal conversion elements H1103.

Figure 7:
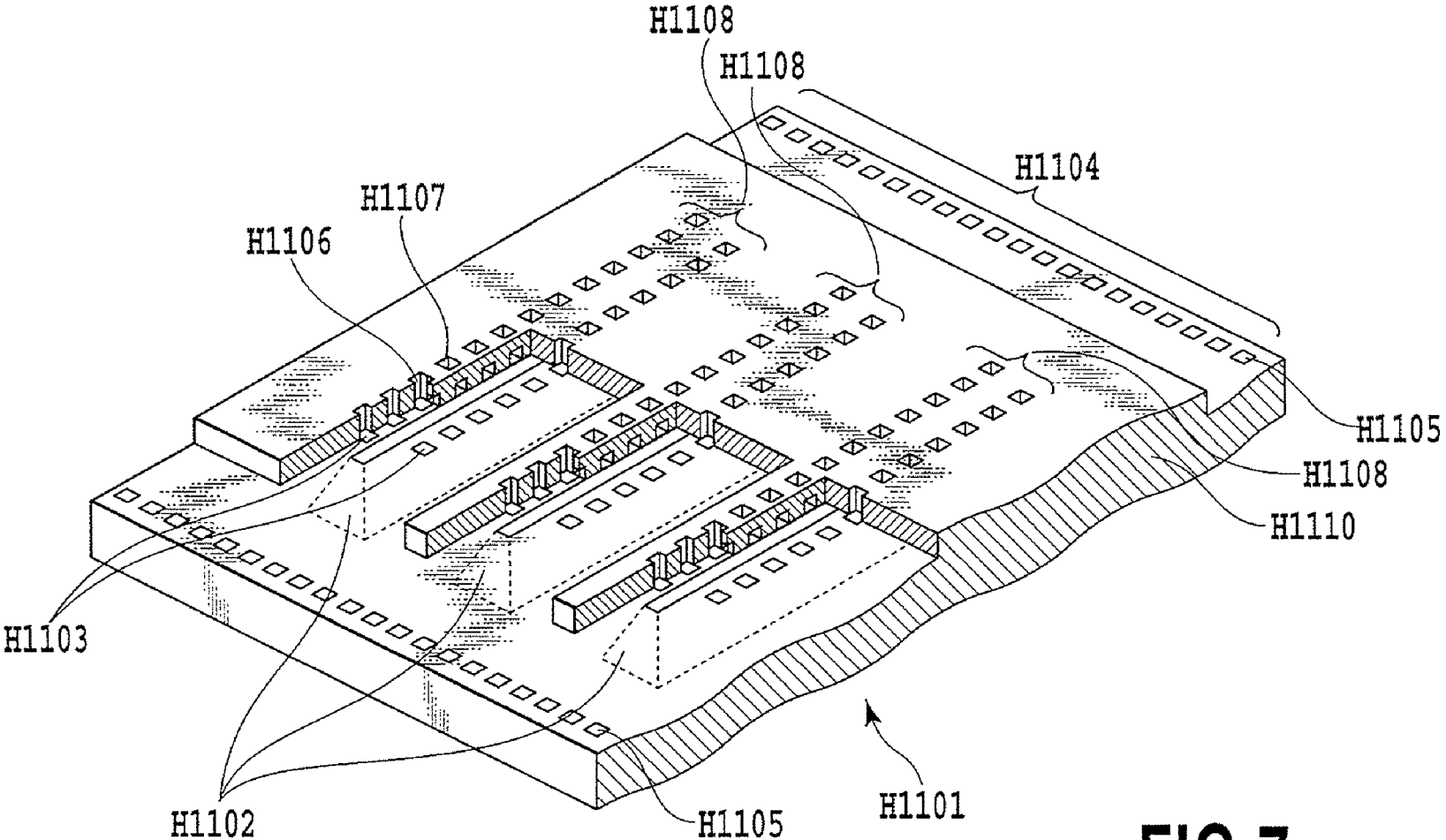
FIG. 7 is a partial perspective view for explaining the structure of the second printing element substrate in the cartridge.
Figure 8:
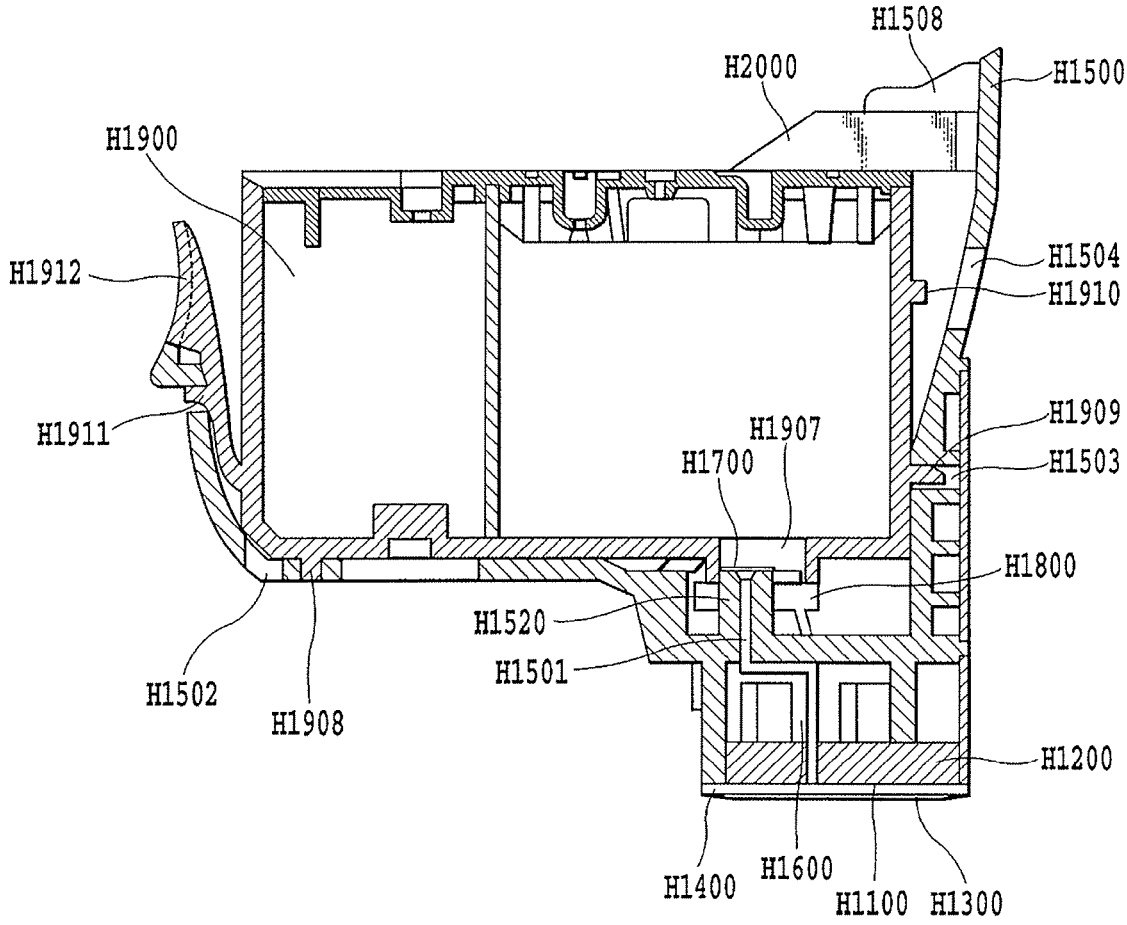
FIG. 8 is a cross-sectional view of the cartridge.

FIG. 7 is a partially cutaway perspective view for explaining the structure of the second printing element substrate H1101. The second printing element substrate H1101 is provided for the ejection ink of three colors of cyan, magenta, and yellow and is formed by three ink ejection openings arranged in parallel to one another. Each of the respective ink supply openings H1102 is sandwiched by the electro-thermal conversion element H1103 and the ink ejection opening H1107 that are arranged in one column in a staggered manner. The Si substrate H1110 also further includes, as in the first printing element substrate H1100, an electric wiring, the electrode section H1104 or the like. The substrate has thereon the ink flow path wall H1106 and the ink ejection opening H1107 by resin material and by the photolithography technique. As in the first printing element substrate, the electrode portion H1104 for supplying power to an electric wiring includes the bump H1105 composed of Au or the like.

The printing element substrates H1100 and H1101 include the respective ink supply openings 1102 that are connected to the ink supply openings H1201 of the first plate H1200 so as to provide communication therebetween and that are adhered to the first plate H1200 in a fixed manner with a high accuracy. The first adhesive agent used for this adhesion desirably has a low viscosity and a low curing temperature and cures within a short time and has a relatively high hardness after curing and has an ink resistance. For example, the first adhesive agent is desirably a thermosetting adhesive agent including epoxy resin as a main component and provides an adhesion layer having a thickness of 50 μm or less.

The second plate H1400 is, for example, a plate-like member having a thickness of 0.5 to 1 mm and is made of ceramic such as alumina (A1203) or the like or metal material such as Al, SUS. The second plate H1400 has a shape that includes two openings having an outer size that is larger than those of the first printing element substrate H1100 and the second printing element substrate H1101 adhered to the first plate H1200 in a fixed manner. The second plate 1400 is adhered to the first plate H1200 by the second adhesive agent. By doing this, when an electric wiring tape H1300 is adhered, the electric wiring tape H1300 can have a contact with the first printing element substrate H1100 and the second printing element substrate H1101 on a flat surface of an adhesion surface to provide an electrical connection.

The electric wiring substrate (tape) H1300 forms an electric signal path for applying an electric signal for ejecting ink to the first printing element substrate H1100 and the second printing element substrate H1101. The electric wiring tape H1300 includes two opening sections corresponding to the respective printing element substrates. In the vicinity of the edges of the opening sections, electrode terminals H302 are formed that are connected to the electrode sections H1104 of the respective printing element substrates H1100 and H1101. At an end section of the electric wiring tape H1300, an electrical contact substrate H2200 having an outer signal input terminal H1302 for receiving an electric signal and an electric terminal connection section H1303 for providing electric connection are formed. The electrode terminal H1302 and the electric terminal connection section H1303 are connected by a continuous wiring pattern of a copper foil.

The electric wiring tape H1300 has a backside that is adhered to the lower surface of the second plate H1400 by the third adhesive agent in a fixed manner and is bent to one side surface of the first plate H1200 to be adhered to a side surface of the first plate H1200 in a fixed manner. The third adhesive agent is, for example, an thermosetting adhesive agent including epoxy resin as a main component and having a thickness of 10 to 100 μm. The electric wiring tape H1300 can be electrically connected to the first printing element substrate H1100 and the second printing element substrate H1101 in the manner as described below. For example, the electrode sections H1104 of the printing element substrates H1100 and H1101 can be electrically joined to the electrode section H1104 of the electric wiring tape H1300 by the thermal ultrasound pressure bonding method. The electric connection between first printing element substrate H1100 and the second printing element substrate H1101 and the electric wiring tape H1300 is sealed by the first sealing agent H1307 and the second sealing agent R1308. This protects the electric connection part from corrosion by ink or an external impact. The first sealing agent H1307 is mainly used to seal the connection part of the electrode terminal H1302 of the electric wiring tape and the electrode sections H1104 of the printing element substrates H1100 and H1101 from the back side and to seal the outer periphery part of the printing element substrates H1100 and H1101. The second sealing agent H1308 is used to seal the connection part from the top side. An end portion of the electric wiring tape H1300 is thermal compressed to the electric contact substrate H2200 by using an anisotropically-conductive film or the like so as to provide an electric connection therebetween. The electric contact substrate H2200 includes a terminal positioning hole H1309 for a positioning purpose and a terminal joint hole H1310 for a fixing purpose.

(1-2) Ink Supply Unit

As shown in FIG. 5, the ink supply member H1500 is one member of the ink supply unit H1003 for guiding ink from the ink tank H1900 to the printing element unit H1002. The ink supply member H1500 is formed by resin formation for example. The resin material is desirably used which is mixed with glass filler of 5 to 40% for improving the rigidity of the shape.

As shown in FIG. 5, the ink supply member H1500 and the tank holder H2000 constitute a receiving portion that receives therein the ink tank 1900 in a detachable manner. This receiving portion includes, at the bottom section thereof, a tank positioning hole H1502 engaged with a tank positioning pin H1908 of the ink tank 1900. The rear wall includes the first hole H1503 engaged with the first nail H1909 of the ink tank and the second hole H1504 engaged with the second nail H1910. Furthermore, the front section of the ink tank H1900 includes a movable lever H1912 including the third nail H1911 engaged with the wall of the receiving portion. By applying a force to this lever H1012 to move the lever H1012 by the elastic deformation, the third nail H1911 can be detached to remove the ink tank H1900. Among these structures, the holes 1503 and 1504 are formed in the ink supply member H1500. Specifically, the ink supply member H1500 partially constitutes the mechanism for retaining the detachable ink tank H1900.

At the position of the bottom portion of the receiving portion of the ink tank H1900 in the ink supply member H1500, a joint portion H1520 which is contacted with the ink supply opening H1907 of the ink tank H1900 is provided. The joint section H1520 is welded with a filter H1700 for blocking dust ingression and is attached with a seal rubber H1800 in order to prevent ink from evaporating from the joint section H1520. The ink supply member H1500 includes, in the inside, the ink flow path H1501 that extends from the contact surface of the joint section H1520 with the ink tank H1900 to the lower surface.

At the bottom surface of the ink supply member H1500, a flow path formation member H1600 is attached in which an ink (liquid) introduction opening H1602 through which ink is supplied to the printing element unit H1002 is opened. In particular, the flow path formation member H1600 is positioned so that a communication between the ink introduction opening H1602 and the ink flow path H1501 of the ink supply member H1500 is established and is attached by the ultrasound welding.

(1-3) Joint between Printing Head Unit and Ink Supply Unit

The printing element unit H1002 and the ink supply unit H1003 are joined to sandwich a joint seal member H2300 having holes at positions corresponding to the ink supply opening H1201 of the first plate H1200 and the ink introduction opening 1602 of the flow path formation member H1600. Both units are pressure-welded by a screw 2400 and are joined to each other in a fixed manner. The joint seal member H2300 is made of elastic material having a small compression set such as rubber. By pressure-welding the ink supply opening 1201 and the ink introduction opening 1602 to have this material therebetween, communication between the ink supply opening 1201 and the ink supply opening 1602 can be favorably provided so as not to cause ink leakage.

The electrical contact substrate H2200 of the printing element unit H1002 is positioned in and fixed to the rear face of the ink supply member H1500. The electrical contact substrate R2200 is positioned through the terminal positioning pins H1515 provided at two positions of the rear face of the ink supply unit H1003 that are provided in the terminal positioning holes H1309. Then, the terminal joint pin H1516 of the ink supply unit H1003 is inserted to the terminal positioning hole H1310 to caulk this terminal joint pin H1516 for fixation. The fixation method is not limited to this and may be other fixation methods.

Figure 9:
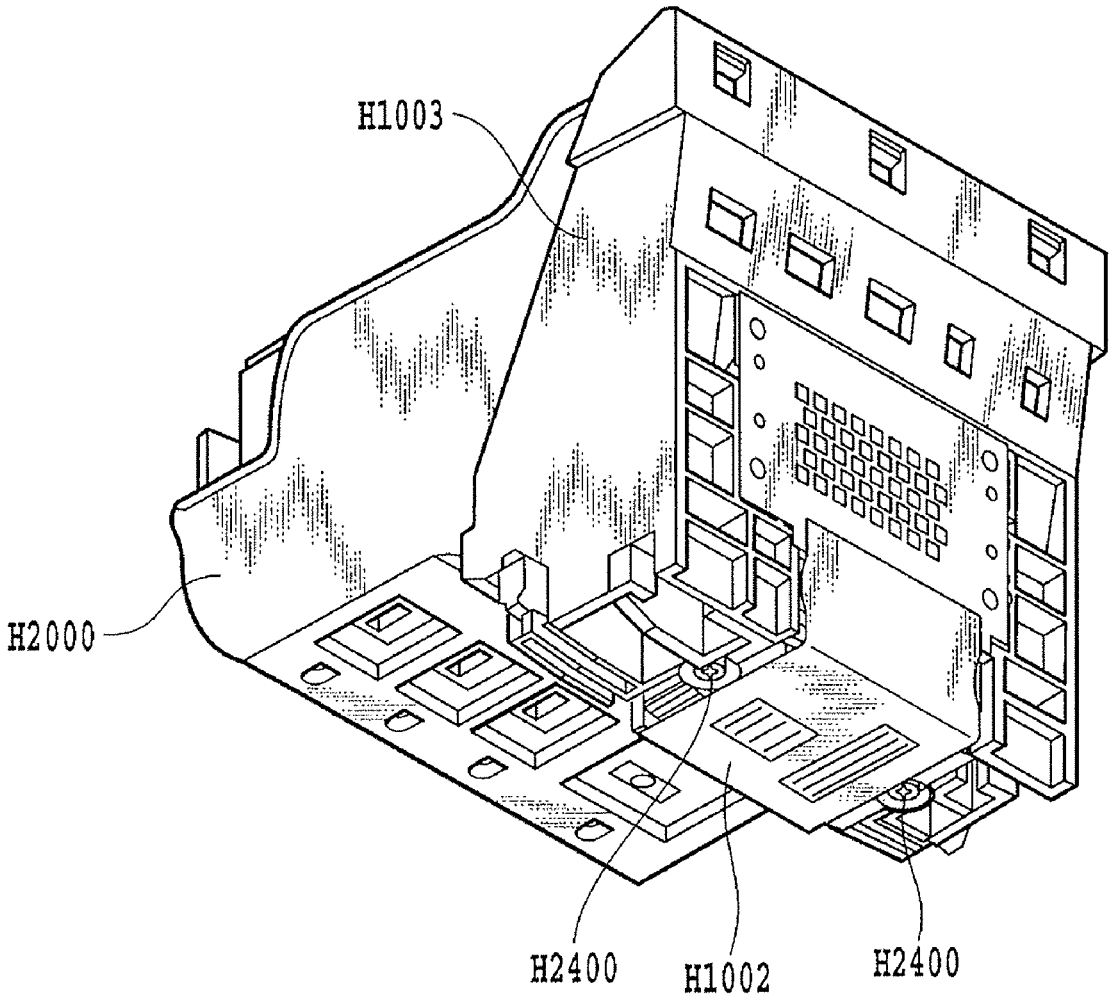
FIG. 9 is a perspective view illustrating a tank holder constituting the cartridge seen from the lower part.

As described above, the ink supply unit H1003 is joined with the printing element unit H1002. The joint hole and the joint section provided in the ink supply member H1500 and the tank holder H2000 are engaged to each other. As a result, the tank holder H2000 is joined as shown in FIG. 9, thus completing the printing head cartridge H1001.

In the printing apparatus, these printing head cartridges are reciprocated in a main scanning direction (carriage moving direction) for example and are controlled by the above-described control circuit so that the printing medium transported in a controlled manner is subjected to a printing operation in a similar manner.

Generation of Maintenance Ejection Data

The ink jet printing apparatus as described above can subject a printing medium to a maintenance ejection that does not have an image formation purpose. Next, data generation in order to perform the maintenance ejection will be described below. Ejection data for the maintenance ejection can be calculated by the CPU 201. Alternately, the maintenance ejection data may be previously stored in the ROM 203 to be used. The maintenance ejection data and printing data are developed into the RAM 205 and are similarly to the printing data transferred to the head driver 240 to cause the ejection heater to operate, thereby ejecting ink. Dots formed by the ink ejection to a printing medium based on the maintenance ejection data form a predetermined pattern. This pattern also may be a plurality of patterns in accordance with a plurality of conditions respectively by means of a control program. Specifically, different levels of defective ejections in a printing head are caused mainly depending on a moisture retention performance and the type of coloring material (dye, pigment) of ink to be used, or an environment temperature of the printing apparatus. Thus, the above predetermined pattern can be changed depending on these conditions. The environment temperature is detected by a temperature sensor 234 provided in the printing apparatus for example.

The maintenance ejection is performed with such an ejection interval (dot interval in the pattern) that is preferably as long as possible in view of the visibility of dots by the ejection and that desirably has a less periodicity. For example, in the scanning direction of the printing head, one ink droplet per one nozzle is ejected not by a continuous ejection with the maximum driving frequency of the printing head but with an interval of a few to a dozen millimeters in view of the width of the printing medium and by not causing a continuous ejection in the nozzle array direction. The number of ejected dots is 3 (3 ejections) to 15 (15 ejections) within a range in which the scanning of the printing head is performed and has no relation with printing data and these dots are ejected to form the predetermined fixed pattern as described above.

Figure 10:
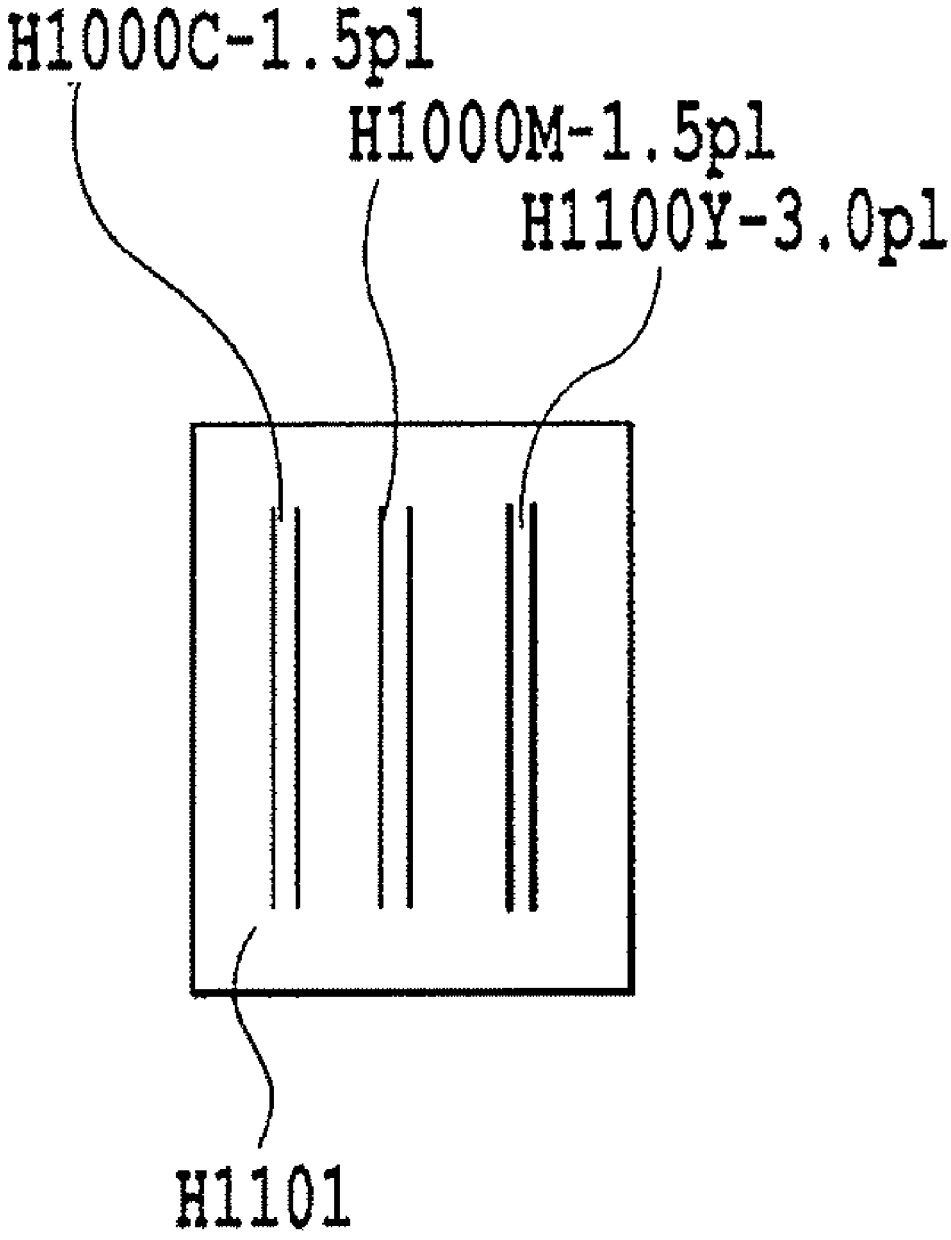
FIG. 10 is a diagram illustrating a second printing element substrate in the cartridge seen from the ejection opening group side.

FIG. 10 is a view illustrating the second printing element substrate H1101 in the head cartridge in this embodiment seen from the ejection opening group and also shows ejection opening (nozzle) groups for the respective colors and in addition shows the ink droplet sizes of the respective nozzle groups. Ink to be used is color inks of cyan, magenta and yellow and the respective inks have independent ejection opening groups and the ink tanks H1900 for the respective colors can be used. It is noted that the ink tank of non-independent also may be substituted by a configuration where the ink rooms for the respective colors are formed in an integrated manner. Further, the resolution of each of the ejection opening groups of the respective colors is 600 dpi for one array and two ejection opening arrays are provided for one color so that the two nozzle arrays are arranged by being dislocated by an amount corresponding to 600 dpi to provide a array resolution of 1200 dpi. In this embodiment, in a case of a normal ejection for a printing operation, each ejection opening of cyan array H1000C-1.5 pl and magenta array H100M-1.5 pl ejects an ink droplet size of about 1.5 pl and each ejection opening of yellow array H1000Y-3.0 pl ejects an ink droplet size of about 3 pl.

(First Embodiment)

Figure 11:
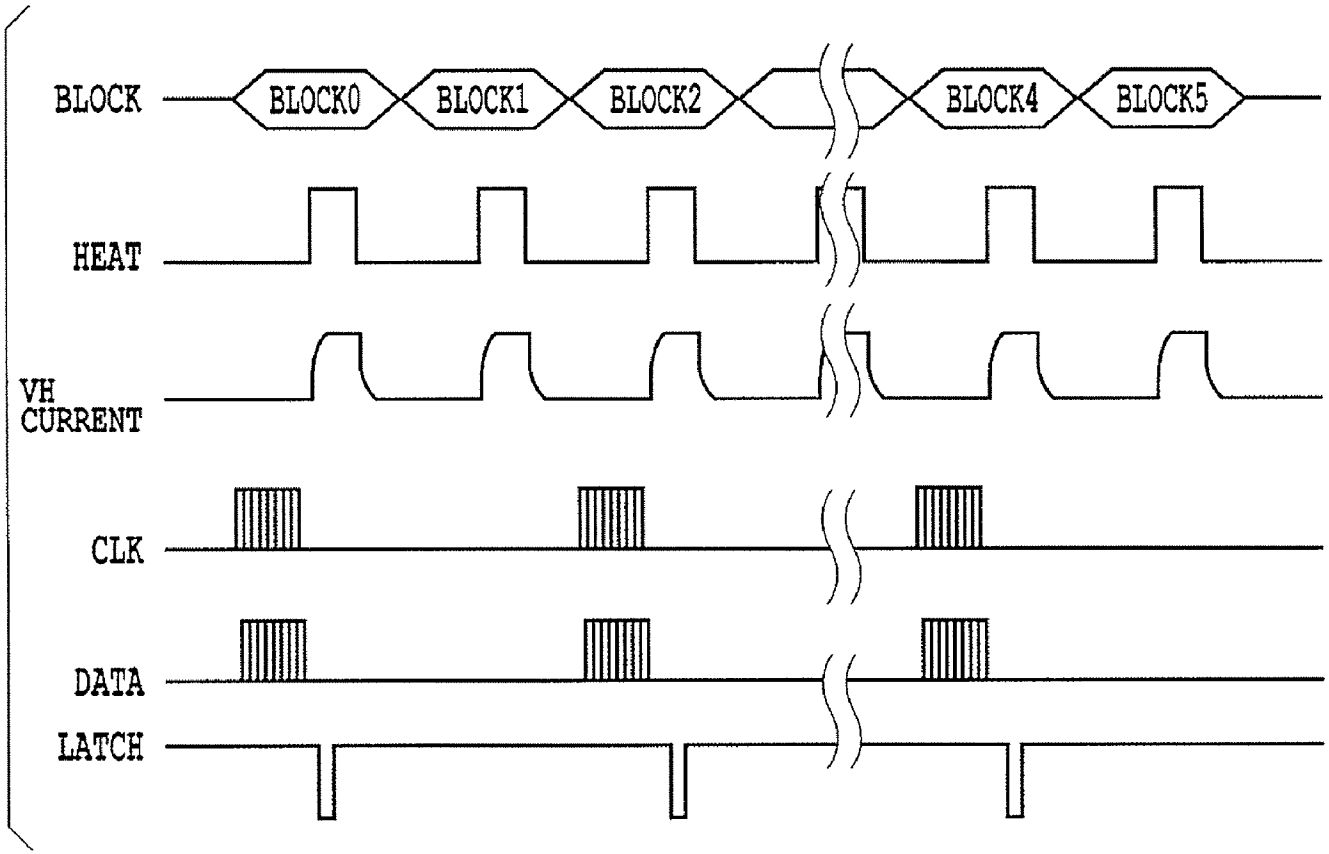
FIG. 11 is a timing chart for explaining the driving of a printing head by a head driver for the respective purposes of the ink ejection for the maintenance ejection and the ink ejection for printing an image.

The maintenance ejection according to a first embodiment of the present invention, which is performed by the ink jet printing apparatus as described above, will be described FIG. 11 is a timing chart for explaining the driving of a printing head by a head driver for the respective purposes of the ink ejection for the maintenance ejection and the ink ejection for printing an image. This timing chart is the similar to the timing chart for the driving of a normal ink ejection for the printing an image. However, the timing chart for the maintenance ejection is different from that for the normal ink ejection in the waveform of current applied to an ejection heater (electro-thermal conversion element). Further, the maintenance ejection based on this chart is performed in a scan different from that in the normal ejection for the printing an image. Specifically, the scan for the maintenance ejection is performed for example for each time printing of a predetermined amount is performed as well-known timing at which the maintenance ejection is performed.

In the head driver of the printing head, a shift register inputs printing information DATA that is ejection data serially supplied through an input terminal based on a transfer clock CLK and outputs the printing information DATA in parallel to a latch. In this embodiment, the shift register is connected to the latch and a latch signal Latch is used to retain the output of the shift register in the latch. A plurality of ejection heaters are divided to a plurality of groups to be driven. Specifically, a heat selection circuit selects a specific group based on a block enable signal (Block0 to Block 5) supplied through an input terminal. Then, a logical product of an ejection signal outputted from an AND circuit depending on printing information and a signal selected and outputted by a selection circuit is outputted to the driving driver. When the output signal is high in this manner, the corresponding driving driver is turned ON and an ejection heater connected to the driving driver is applied with current and is driven to generate heat. Then, film boiling of ink in the nozzle causes ink droplets to be ejected from the ejection opening. In the above configuration, a printing information signal HEAT that is a signal for determining the waveform of current flowed in the ejection heater is outputted in synchronization with the above selection signal.

This embodiment differentiates the contents of the printing information signal HEAT for an ejection for an image printing purpose from that for a maintenance ejection. As a result, an ink dot formed on a printing medium for the maintenance ejection purpose can have a smaller area than that of an ink dot formed for the image printing purpose, thus providing dots by the maintenance ejection with a reduced visibility.

FIGS. 12A to 12F are diagrams illustrating driving conditions of the printing head for the maintenance ejection and the image printing, and ink droplets and ink dots ejected by the maintenance ejection and the image printing.

Figure 12A:
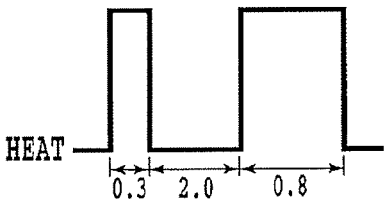
FIGS. 12A to 12F are diagrams illustrating driving conditions of the printing head of the maintenance ejection and the image printing according to the first embodiment of the present invention and ink droplets and ink dots ejected by the maintenance ejection and the image printing.
Figure 12D:
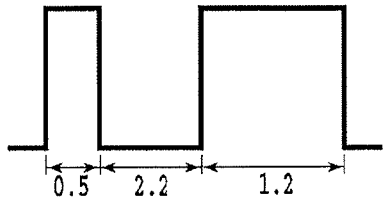

FIGS. 12A and 12D illustrate driving conditions of the ejection for the image printing and the maintenance ejection. The driving voltage and a driving frequency for the printing head is 16V and 15 KHz respectively. Under these driving conditions, the ejection for the image printing and the maintenance ejection are performed during the same contents of scans. Specifically, an ink ejection is performed with a resolution of 600 dpi in a scanning direction with a scanning rate of 25 inch/sec.

As shown in FIG. 12A, a driving waveform of an applied pulse for one ejection for the purpose of the image printing is structured so that a main pulse of 0.8 μs is applied after an application of a pre-pulse of 0.3 μs and pausing an interval time of 2.0 μs. Ink is ejected when the main pulse is applied. On the other hand, as shown in FIG. 2B, a driving waveform of an applied pulse for one ejection for the maintenance ejection purpose is structured so that a main pulse of 1.2 μs is applied after an application of a pre-pulse of 0.5 μs and pausing an interval time of 2.2 μs. As is clear from these driving conditions, the driving energy for the maintenance ejection purpose is greater than the driving energy for the image printing purpose.

Figure 12B:
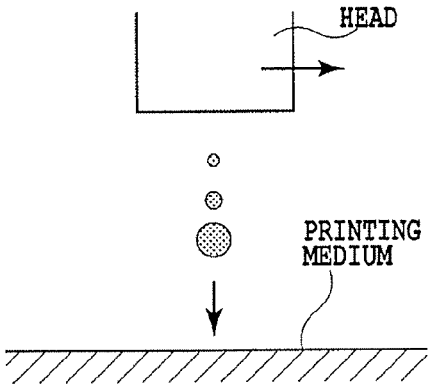
Figure 12E:
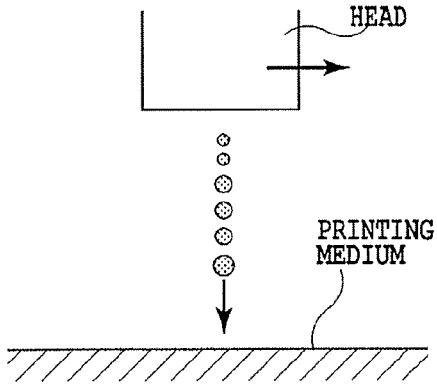

FIGS. 12B and 12E illustrate the ejection conditions of ink droplets in the image printing and in the maintenance ejection, respectively. The respective ejected ink droplets consist of a plurality of ink droplets composed of a main droplet and sub droplets (satellites). During this ejection, the printing heads mounted on the carriage are moved in the direction designated by an arrow in the drawing with a speed of 25 inch/sec, respectively. As shown in FIG. 12B, the ejection condition for the image printing is such that an ink droplet having a volume of 1.5 pl is ejected toward a printing medium with 13 m/sec. While flying toward the printing medium, the ink droplet is divided to a main droplet and two sub droplets for example and the main droplet and the sub droplets land on the printing medium. On the other hand, as shown in FIG. 12E, the ejection condition of the maintenance ejection is such that an ink droplet having a volume of 1.9 pl is ejected to a printing medium with 18 m/sec. While flying toward the printing medium, the ink droplet is divided to a main droplet and five sub droplets for example and the main droplet and three sub droplets land on the printing medium. The remaining two sub droplets stall before reaching the printing medium and float as mist.

Figure 12C:
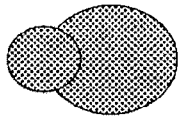
Figure 12F:
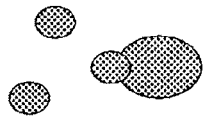

FIGS. 12C and 12F show an example of dots formed by ink droplets form the printing head ejected as shown in FIG. 12B and FIG. 12E for the image printing and for the maintenance ejection, respectively. It is noted that the printing medium of this embodiment is a plain paper using pulpwood. These dots are expanded by a microscope for observation and the image of the dots is taken by a CCD camera and is subjected to binarization to calculate the areas of the dots. The dots for the image printing shown in FIG. 12C have an area of 628 $\mu m^2$ and the dots for the maintenance ejection shown in FIG. 12F have an area of 512 $\mu m^2$. Specifically, by using different waveforms flowed into ejection heaters of the printing head in the ejection for the image printing and for the maintenance ejection, dots formed by the maintenance ejection can have a smaller area than that of dots formed by the ejection for the normal image printing.

FIG. 13 is a chart illustrating the evaluation of the visibility of dots by the normal ejection (1.5 pl) for the image printing and dots by the maintenance ejection (1.9 pl), described referring to FIGS. 12A to 12F. FIG. 13 also shows the visibility of dots of 5 pl and 3 pl by the normal ejection for reference. The result shown in FIG. 13 shows the visibility of dots formed when 3 to 6 ink droplets are ejected onto a printing medium. In FIG. 13, the mark "o" denotes that the visibility of dots is low (not so noticeable) and the marks "Δ" and "x" denote that the visibility is higher (more noticeable) in this order. According to the evaluation result, yellow is preferably provided with an ink droplet size of 1.5 pl or less in view of the visibility for the maintenance ejection. However, in this embodiment, yellow having an ink droplet size of 3.0 pl in a condition of the normal ejection and thus a yellow dot has relatively high visibility. Further, In the case of cyan, magenta, and Photo-Black, an ink droplet size is 1.5 pl in this embodiment and this size also causes a high dot visibility in the normal ejection for an image printing. It should be noted that, in the case of an image printing, although the result depends on printing data, about 3 to 6 ink droplets are not ejected but more ink droplets are ejected to form dots that form an image. Thus, there is no problem even when dots formed by about 3 to 6 ink droplets have a high visibility. On the other hand, dots formed by ink droplets ejected based on the driving conditions of the maintenance ejection have a low visibility for every type of yellow, cyan, magenta and photo-black inks.

As described above, in this embodiment, the volume of ink droplets ejected in the maintenance ejection is larger than that of the normal ejection. However, ejection driving for the maintenance ejection is performed so that the number of ink droplets divided to a main droplet and sub droplets is greater than the normal ejection. As a result, ink droplets to become mist for prevented from being adhered to a printing medium are caused so that an area of dots finally formed on the printing medium is smaller than that by the normal printing. It is noted that, although FIGS. 12E and 12F show an example in which ejected ink droplets are divided to five sub droplets and three sub droplets of them land to a printing medium, the number of sub droplets and the number of landed sub droplets are not limited to this case. Any number of sub droplets may be used so long as an area of dots finally formed by a main droplet and sub droplets landed on the printing medium is smaller than that by the normal printing and causes a low visibility. As described above, the visibility can be reduced by reducing the area of formed dots depending on driving conditions. It is noted that an ink droplet size for the maintenance ejection also may be determined based on, in addition to the above driving conditions, a characteristic of used ink and the level of bleeding on a printing medium for example.

As described above, a driving condition deferent from a driving condition for the normal ejection is preferably determined, as driving condition for the maintenance ejection, with regards to at least cyan, magenta, and Photo-Black inks. It should be noted that, in this embodiment, a driving condition for the maintenance ejection with regard to yellow is not determined because the granularity due to the maintenance ejection for yellow ink (size of 3.0 pl) is less noticeable than that of other ink such as cyan and magenta. According to the above configuration of this embodiment, the granularity due to the maintenance ejection is prevented from being noticeable in a half tone part having a gray, and a color halftone part of a graphic image, a shadow part in a photograph image, and a highlight such as blue sky and human skin. Furthermore, even when an improved image resolution provides a small droplet of 1.5 pl of cyan and magenta to increase the number of ejections for the maintenance ejection, the driving method of this embodiment can be performed to effectively prevent the print throughput from being reduced without causing a reduced image quality. Furthermore, an ink droplet size, such as yellow ink droplet of 3 pl, larger than the ink droplet size of an ink color having a high dot visibility, such as cyan, magenta, due to the maintenance ejection reduces the ink ejection energy, which is preferable from a viewpoint of heat accumulation in the printing head and also can contribute to the suppression of the reduced print throughput.

(Second Embodiment)

The second embodiment of the present invention is similar to the above-described embodiment in that the printing head during the maintenance ejection to a printing medium is driven so that the dot visibility due to the maintenance ejection is low. It is noted that the same components as those of the above-described first embodiment will not be described further. FIGS. 14A to 14F are diagrams illustrating driving conditions of the image printing and the maintenance ejection according to the second embodiment of the present invention and ejected ink droplets and dots formed by the droplets.

Figure 14A:
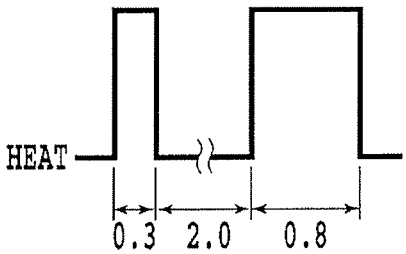
FIGS. 14A to 14F are diagrams illustrating driving conditions of the image printing and the maintenance ejection according to the second embodiment of the present invention and ejected ink droplets and dots formed by the droplets.
Figure 14D:
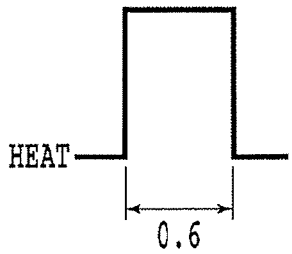

FIGS. 14A and 14D illustrate the waveforms of the driving currents for the image printing and the maintenance ejection, respectively. This printing head driving is performed with a driving voltage of 16V and a driving frequency of 15 KHz. Ink is ejected with a resolution of 600 dpi in the scanning direction and the scanning rate is 25 inch/sec. As shown in FIG. 14A, an applied pulse for the image printing has a driving waveform in which a pre-pulse of 0.3 μs is applied and then a main pulse of 0.8 μs is applied with an interval of 2.0 μs therebetween. On the other hand, as shown in FIG. 14D, an applied pulse for the maintenance ejection has a driving waveform that has no pre-pulse or interval and thus only a main pulse of 0.6 μs is applied. This causes an opposite result to that of the above-described first embodiment in which the driving energy for one ejection for the maintenance ejection is smaller than the driving energy for one ejection for the image printing.

Figure 14B:
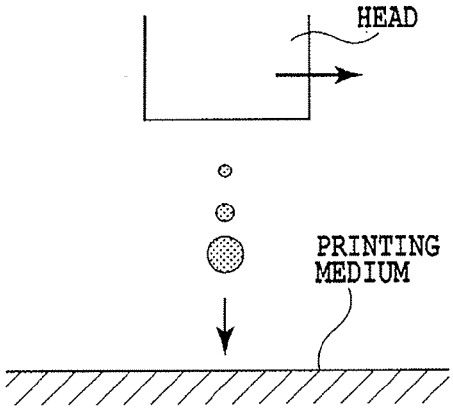
Figure 14E:
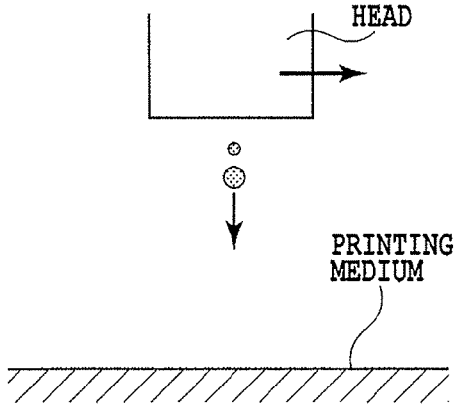

FIGS. 14B and 14E illustrate ejection conditions of ink droplets in the normal image printing and in the maintenance ejection, respectively. In the respective cases, the printing head ejects ink droplets while scanning in the direction shown by the arrow with a speed of 25 inch/sec. The ejected ink droplets fly from the head toward a printing medium. Then, the ink droplets are divided into a main droplet and sub droplets and the divided droplets land on the printing medium. As shown in FIG. 14B, in the ejection condition of the image printing, an ink droplet having a volume of 1.5 pl is ejected with a speed of 13 m/sec. Then, while approaching the printing medium, the droplets are divided to a main droplet and two sub droplets for example and land on the printing medium. On the other hand, in the ejection condition of the maintenance ejection as shown in FIG. 14E, an ink droplet having a volume of 1.1 pl is ejected with a speed of 10 m/sec.

Then, while approaching the printing medium, the droplets are divided into a main droplet and one sub droplet for example and land on the printing medium. This embodiment is different from the above-described first embodiment in that the ejection driving in the maintenance ejection is performed based on a condition that causes divided droplets having a size by which the droplets are prevented from being mist. As a result, all of the main droplet and sub droplet land on the printing medium to form dots.

Figure 14C:
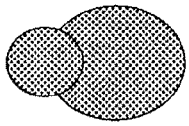
Figure 14F:
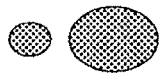

Dots formed on the printing medium in the image printing and the maintenance ejection are expanded by a microscope for observation and the images are taken by a CCD camera and are subjected to binarization to measure the respective areas of the images. The area of dots for the image printing shown in FIG. 14C is 628 μm2 and the area of dots for the maintenance ejection shown in FIG. 14F is 410 μm2.

FIG. 15 is a chart illustrating the evaluation of the visibility of dots by the ejection for the image printing and dots by the maintenance ejection. As in FIG. 13, the visibilities of dots by the ejection of the volumes of 5 pl and 3.0 pl are also shown for reference. The evaluation of FIG. 15 shows the visibilities of dots formed by ejecting about 3 to 6 ink droplets as in the first embodiment. In FIG. 15, the mark "o" denotes that the visibility of dots is low (not so noticeable) and the marks "Δ" and "x" denote that the visibility is higher (more noticeable) in this order. It is noted that the printing medium for which the visibility was evaluated was a plain paper using pulpwood.

According to the evaluation shown in FIG. 15, yellow ink is preferably ejected with an ejection volume of about 1.5 pl or less in view of the visibility due to the maintenance ejection. It should be noted that yellow ink of 3.0 pl is in a range of use in terms of vicinity, and thus in the embodiment, the yellow ink having a volume of 3.0 pl is ejected also in the maintenance ejection as in the normal ejection. With regards to cyan, magenta, and Photo-black inks, the driving conditions for the normal printing having an ink droplet volume of 1.5 pl are not sufficient for the maintenance ejection and the maintenance ejection based on the driving conditions according to this embodiment is preferred. It is noted that an ink droplet size also may be determined based on the performance of used ink and the rate of bleeding on a printing medium for example.

This embodiment determines the driving condition (FIG. 14A) for the normal ejection for 1.5 pl of cyan ink and 1.5 pl of magenta ink and determines the driving condition (FIG. 14D) for the maintenance ejection so that dots formed on a printing medium has a low visibility (so that the dots are not so noticeable), respectively. This can prevent the granularity due to the maintenance ejection is prevented in a half tone part having a gray, and a color halftone part of a graphic image, a shadow part in a photograph image, and a highlight such as blue sky and human skin from being noticeable. Furthermore, even when an improved image resolution provides a small droplet of 1.5 pl of cyan and magenta to increase the number of ejections for the maintenance ejection, the driving method of this embodiment can be performed to effectively prevent the print throughput from being reduced without causing a reduced image quality. Furthermore, even when an improved image resolution provides a small droplets of cyan and magenta (e.g., 1.5 pl) to increase the number of ejections for the maintenance of the nozzle, the driving method of this embodiment can be performed to effectively prevent the print throughput from being reduced without causing a reduced image quality. Furthermore, an ink droplet size larger than the ink droplet size of an ink color having a high dot visibility due to the maintenance ejection (e.g., yellow ink droplet of 3 pl) reduces the ink ejection energy, which is preferable from a viewpoint of heat accumulation in the printing head and also can contribute to the suppression of the reduced print throughput.

Figure 16:
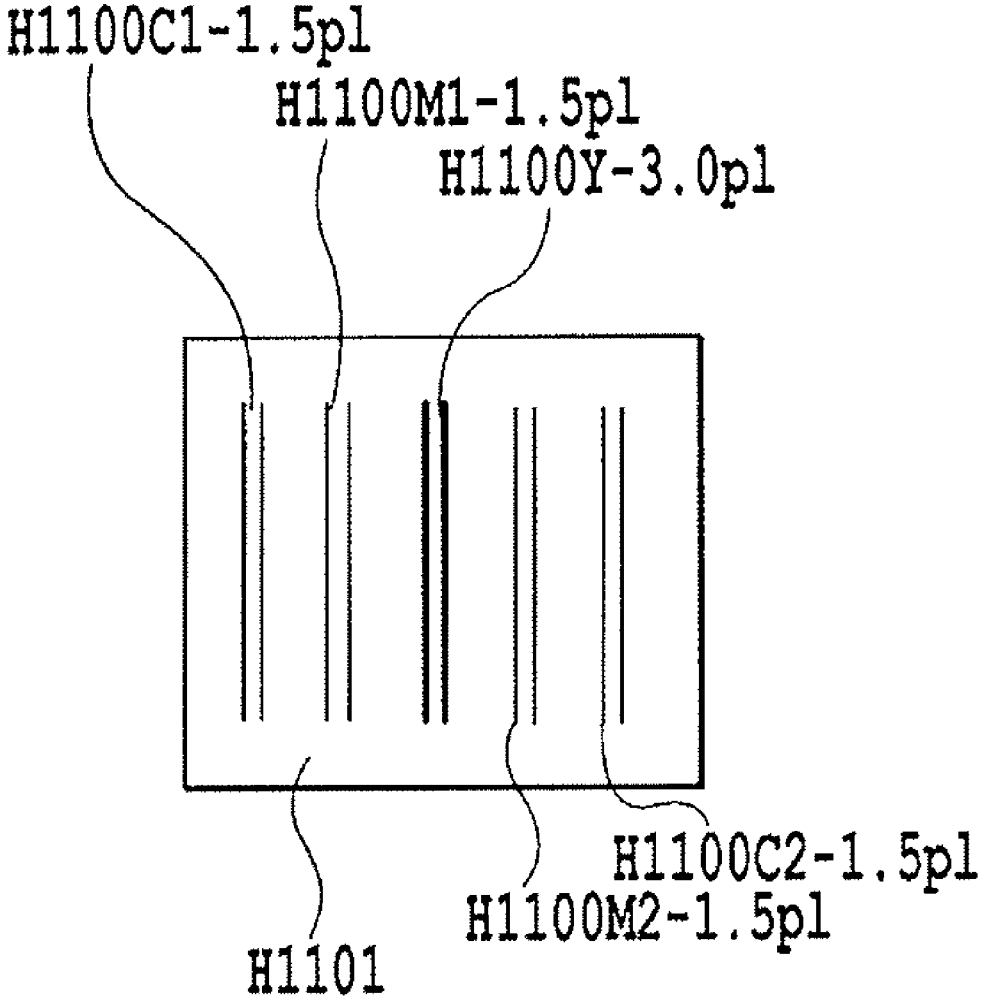
FIG. 16 is a diagram illustrating a printing head according to the second embodiment.

FIG. 16 is a view illustrating a printing head according to the second embodiment of the present invention. As in FIG. 10, FIG. 16 illustrates the second printing element substrate H1101 seen from the ejection opening group and shows the ejection opening groups for the respective colors and the structure of a liquid droplet size. The printing head of this embodiment is different from the first embodiment in that the respective two groups for cyan and magenta having an ink droplet size of about 1.5 pl are provided.

The nozzle group for the first cyan H1100C1-1.5 pl and the nozzle group for the first magenta H1100M1-1.5 pl are provided. Between these nozzle groups and the nozzle group for the second cyan H1100C2-1.5 pl and the nozzle group for the second magenta H1100C2-1.5 pl, the nozzle group for yellow H1100Y-3.0 pl having an ink droplet size of about 3 pl is sandwiched. The second magenta nozzle group and the second cyan nozzle group are arranged so that the order of the second nozzle groups is opposite to the order of the first cyan and magenta nozzle groups. This is for the purpose of allowing, when scanning of a printing head is executed in outward and homeward paths so that a printing is performed in both directions, an image of mixed colors (e.g., red, blue, green, and gray requiring the three colors) to be prepared by ejecting the respective colors of inks onto a paper in the same order. This can prevent uneven printing of the mixed colors and is suitable for a high-speed printing.

It is noted that one column of a ejection group composed of the respective colors has a resolution of 600 dpi and one color is provided with two arrays of ejection openings provided so that each nozzle array for one color is dislocated from another array by an amount corresponding to 600 dpi, thus providing a resolution of 1200 dpi. With regards to a ejection opening group having two ejection opening groups for one color, the first two ejection opening group is dislocated from the second two ejection opening group by an amount corresponding to 1200 dpi for example so that a resolution of 2400 dpi can be provided for one color of cyan.

Figure 17A:
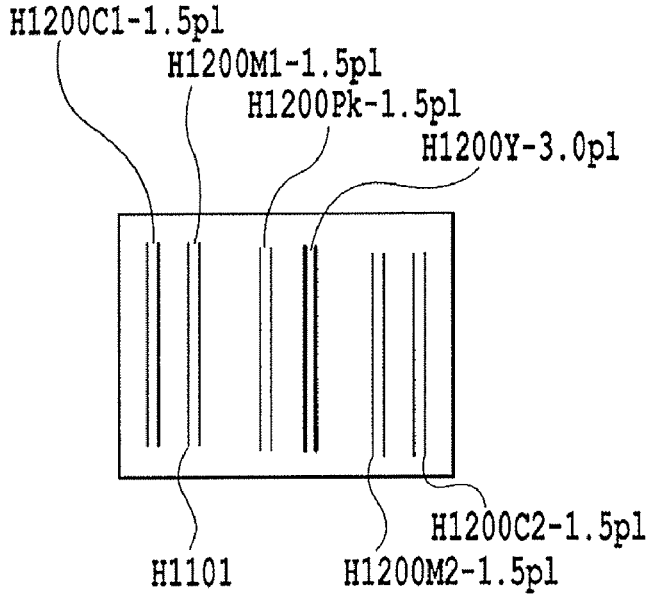
FIGS. 17A and 17B are diagrams illustrating an example where a nozzle arrangement of the printing head shown in FIG. 16 further includes nozzle arrangements of a Photo Black H1200Pk, a Photo Magenta H1200PM, and a Photo Cyan HI1200PC are arranged.
Figure 17B:
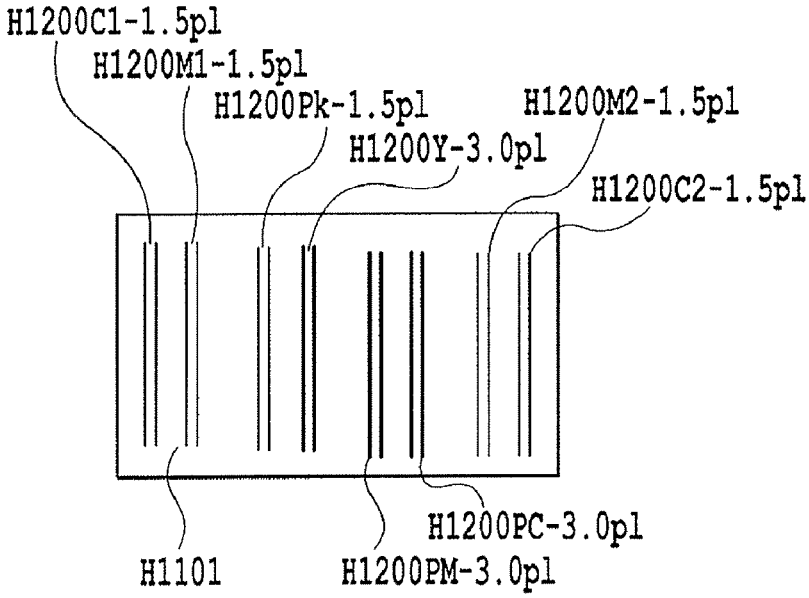

FIGS. 17A and 17B illustrate an example where a nozzle arrangement of the printing head shown in FIG. 16 further includes nozzle arrangements of a Photo-black H1200Pk, a Photo-magenta H1200PM, and a Photo-cyan HI1200PC are arranged.

Figure 18A:
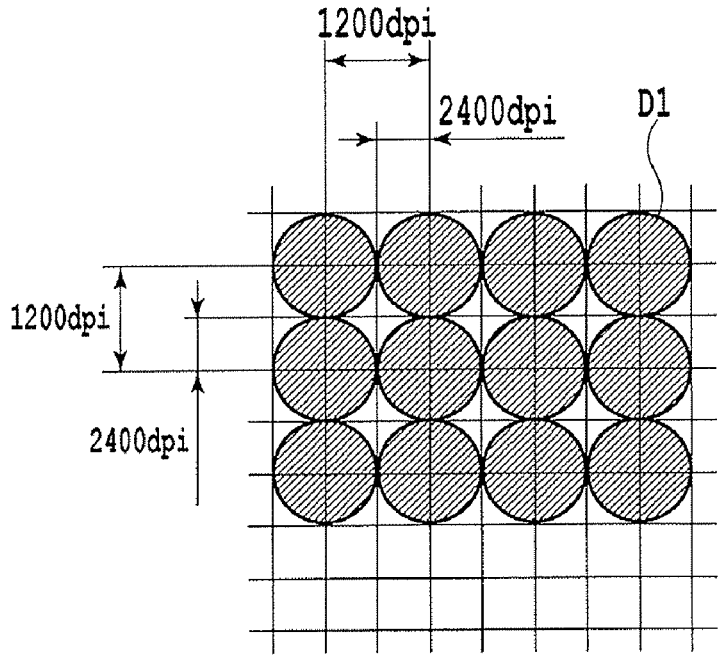
FIGS. 18A and 18B are diagrams illustrating ink dots formed based on a unit resolution in one scanning by a printing head.
Figure 18B:
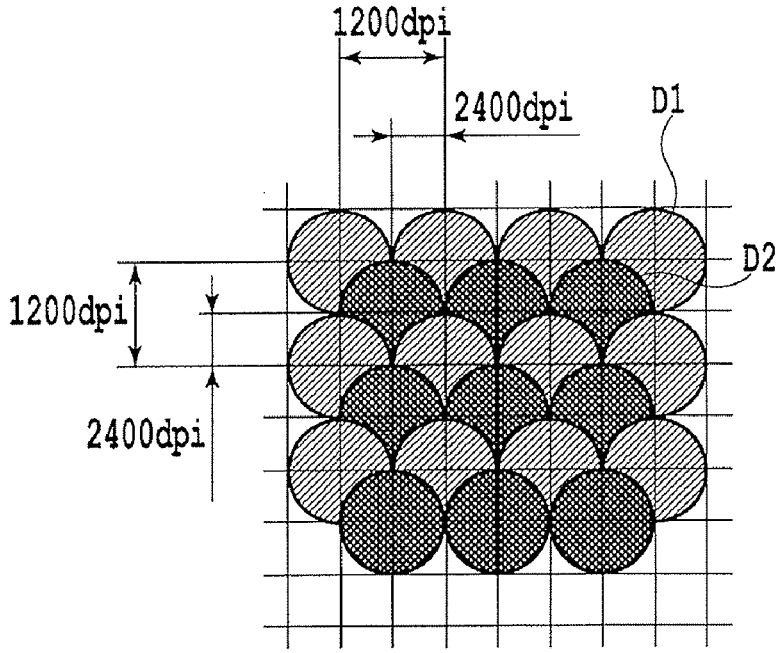

In the printing structure as described above, a high-speed printing can be provided by printing dots onto a printing medium by one scanning of the printing head. The expression of "printing dots" herein will be described with reference to FIGS. 18A and 18B. FIGS. 18A and 18B illustrate ink dots formed based on a unit resolution when the printing head performs one scanning. FIG. 18A illustrates how dots are printed on a printing medium by a printing head of 1200 dpi having only one column for one color (e.g., cyan) when an ink droplet size of 1.5 pl. Since the printing dot D1 has a dot diameter smaller than the resolution density of the printing head, a gap is conspicuous. On the other hand, FIG. 18B shows dot formation when two columns of cyan are provided in this embodiment. As shown in FIG. 18B, the dot D1 ejected from the first cyan H1100C1-1.5 pl and the dot D2 ejected from the second cyan H1100C2-1.5 pl are formed within one scanning of the printing head. Thus, dots forming an image are formed on the printing medium without causing a gap. As a result, one scanning by the printing head can provide an image having a sufficiently high concentration. Yellow is further provided at the center to provide a color arrangement relative to the first cyan and magenta and the second cyan and magenta. This can prevent a color difference due to the difference in an order of colors of inks printed onto a paper by the scanning of the printing head in outward and homeward directions. As a result, printing in both directions can be provided to realize a high-speed printing in both directions with a nozzle length of a printing head having a width of one scanning region. Furthermore, an yellow ink droplet size of about 3 pl as in the first embodiment suppresses the heat accumulation in the printing substrate during a high-speed printing, thus further contributing to a high-speed printing.

As in this embodiment, by reducing, for the formation of a photograph image, the visibility of dots by the maintenance ejection by ink droplets of an ink color that enhances the image quality, a high-quality image can be obtained with a high speed while performing the maintenance ejection that is not for the purpose of providing an image on a printing medium. An addition of an ink color improving the quality of a photograph image as in this embodiment is also applicable to the structure of the first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-380071, filed Dec. 28, 2005, which is hereby incorporated by reference herein in its entirety.

What is claimed is:

1. An ink jet printing apparatus comprising:

a printing head for ejecting ink by utilizing thermal energy generated by applying a pulse to a heater of said printing head;

a pulse control means for controlling the pulse applied to the heater;

a control means for causing said printing head to eject ink at a position at which said printing head faces a printing medium by applying a first pulse controlled by said pulse control means to the heater according to image data to perform printing; and a maintenance means for causing said printing head to eject ink at a position at which said printing head faces the printing medium by applying a second pulse controlled by said pulse control means to the heater, according to a predetermined pattern, to execute a maintenance, wherein the second pulse causes the heater to generate greater thermal energy than the first pulse, the greater thermal energy causing an area of a dot formed on the printing medium by the ink droplets ejected by the second pulse to be smaller than an area of a dot formed on the printing medium by the ink droplets ejected by the first pulse, and wherein ink is ejected to be separated into a plurality of ink droplets by the second pulse, the number of separated ink droplets being greater than the number of ink droplets ejected by the first pulse, and wherein an area of the ink droplets ejected by the second pulse are smaller than an area of a dot formed on the printing medium with the ink droplets ejected by the first pulse.

2. An ink jet printing apparatus as claimed in claim 1, wherein the second pulse is determined so that all of the separated ink droplets, including a main droplet and a sub droplet, ejected from the printing head land on the printing medium.

3. An ink jet printing apparatus as claimed in claim 1, wherein the predetermined pattern according to which the second pulse is applied for ejecting ink is a previously set fixed pattern.

4. An ink jet printing method comprising:

a moving step for causing a printing head for ejecting ink by utilizing thermal energy generated by applying a pulse to a heater of the printing head to face a printing medium;

a printing step for causing the printing head to eject ink by applying a first pulse to the heater according to image data to perform printing, while moving the printing head by said moving step; and a maintenance step for causing the printing head to eject ink by applying a second pulse to the heater according to a predetermined pattern, to execute a maintenance, while moving the printing head by said moving step, wherein the second pulse applied to the heater in said maintenance step is a pulse that causes the heater to generate greater thermal energy than the first pulse, the greater thermal energy causing an area of a dot formed on the printing medium by the ink droplets ejected by the second pulse to be smaller than an area of a dot formed on the printing medium by the ink droplets ejected by the first pulse, and wherein ink is ejected to be separated into a plurality of ink droplets in one ink ejection by the second pulse, the number of separated ink droplets being greater than the number of ink droplets in one ink ejection by the first pulse.

5. An ink jet printing method as claimed in claim 4, wherein the second pulse is determined so that all of ink droplets, including a main droplet and a sub droplet, ejected from the printing head land on the printing medium.

6. An ink jet printing method as claimed in claim 4, wherein the predetermined pattern according to which the second pulse is applied for ejecting ink is a previously set fixed pattern.

* * * * *